US012595521B2

(12) United States Patent
Murray

(10) Patent No.: US 12,595,521 B2
(45) Date of Patent: Apr. 7, 2026

(54) METHOD AND DEVICE FOR PRODUCING DIRECT REDUCED METAL

(71) Applicant: GREENIRON H2 AB, Stockholm (SE)

(72) Inventor: Hans E.H. Murray, Djursholm (SE)

(73) Assignee: GREENIRON H2 AB, Stockholm (SE)

( * ) Notice: Subject to any disclaimer, the term of this patent is extended or adjusted under 35 U.S.C. 154(b) by 494 days.

(21) Appl. No.: 18/011,820

(22) PCT Filed: Jun. 24, 2021

(86) PCT No.: PCT/SE2021/050632
§ 371 (c)(1),
(2) Date: Dec. 20, 2022

(87) PCT Pub. No.: WO2021/262078
PCT Pub. Date: Dec. 30, 2021

(65) Prior Publication Data

US 2023/0235418 A1 Jul. 27, 2023

(30) Foreign Application Priority Data

Jun. 26, 2020 (SE) ..... 2050771-1

(51) Int. Cl.
*C22C 13/00* (2006.01)
*C21B 13/00* (2006.01)
*C23C 8/22* (2006.01)

(52) U.S. Cl.
CPC ..... *C21B 13/0033* (2013.01); *C21B 13/004* (2013.01); *C21B 2100/64* (2017.05);
(Continued)

(58) Field of Classification Search
CPC ... C21B 13/0033; C21B 13/004; C21B 13/10; C23C 8/22; Y02P 10/134
See application file for complete search history.

(56) References Cited

U.S. PATENT DOCUMENTS 2,900,246 A 8/1959 Keith et al.
2,915,379 A 12/1959 Agarwal
(Continued)

FOREIGN PATENT DOCUMENTS

CA 3103187 A1 12/2019
CN 1383453 A 12/2002
(Continued)

OTHER PUBLICATIONS

International Search Report from corresponding International Application No. PCT/SE2021/050632, dated Sep. 10, 2021, 10 pages.
(Continued)

*Primary Examiner* — Jessee R Roe
(74) *Attorney, Agent, or Firm* — Tucker Ellis LLP

(57) ABSTRACT

Method for producing direct reduced metal material, comprising the steps: a) charging metal material (142) to be reduced into a furnace space (120); b) providing heat and a reducing gas into the furnace space (120), so that heated reducing gas heats the charged metal material (142) to a temperature high enough so that metal oxides present in the charged metal material (142) are reduced, in turn causing water vapour to be formed; and c) condensing and collecting the water vapour formed in step c in a condenser (280); The method is characterised in that, in step a), the metal material (142) is charged onto a gas-permeable floor (151), in that the reducing gas is circulated in a closed loop upwards through said floor (151), through the charged metal material (142), and further via said condenser (280) and a gas forced circulation device (250), and in that the method further comprises the step d) supplying additional reducing gas to achieve and/or maintain a predetermined pressure in said furnace space (120). The invention also relates to a system.

19 Claims, 7 Drawing Sheets

(52) U.S. Cl.
CPC ..... *C21B 2100/66* (2017.05); *C21B 2300/02* (2013.01); *C23C 8/22* (2013.01)

(56) References Cited

U.S. PATENT DOCUMENTS

| | | | | |
|---|---|---|---|---|
| 3,022,156 | A | 2/1962 | Eastman | |
| 3,140,940 | A | 7/1964 | Keith | |
| 3,389,988 | A * | 6/1968 | Cambon | C21B 13/0033 75/450 |
| 3,964,898 | A | 6/1976 | Murray | |
| 4,089,681 | A | 5/1978 | Gueussier | |
| 4,150,972 | A | 4/1979 | Price-Falcon et al. | |
| 4,160,662 | A | 7/1979 | Nagasaki et al. | |
| 4,160,663 | A | 7/1979 | Hsieh | |
| 4,216,011 | A | 8/1980 | Vera et al. | |
| 5,118,479 | A | 6/1992 | Stephens, Jr. | |
| 5,137,566 | A | 8/1992 | Stephens, Jr. et al. | |
| 5,542,963 | A | 8/1996 | Sherwood | |
| 5,545,251 | A | 8/1996 | Knop | |
| 5,885,325 | A | 3/1999 | Geiger et al. | |
| 5,897,829 | A | 4/1999 | Kim et al. | |
| 6,569,220 | B1 | 5/2003 | Clark et al. | |
| 8,915,352 | B2 | 12/2014 | Tsuge et al. | |
| 2020/0048724 | A1 | 2/2020 | Green et al. | |
| 2022/0010405 | A1 | 1/2022 | Murray | |

FOREIGN PATENT DOCUMENTS

| | | | |
|---|---|---|---|
| CN | 102232119 | A | 11/2011 |
| CN | 102443668 | A | 5/2012 |
| CN | 102844459 | A | 12/2012 |
| CN | 107217155 | A | 9/2017 |
| CN | 107227385 | A | 10/2017 |
| CN | 112410493 | A | 2/2021 |
| EP | 0541711 | B1 | 1/1999 |
| EP | 3708684 | A1 | 9/2020 |
| JP | S54126618 | A | 10/1979 |
| JP | S59104410 | A | 6/1984 |
| JP | S63140011 | A | 6/1988 |
| JP | 04254796 | A | 9/1992 |
| JP | H07150211 | A | 6/1995 |
| JP | 10316412 | A | 12/1998 |
| JP | 11171526 | A | 6/1999 |
| JP | 2017226893 | A | 12/2017 |
| SE | 7406174-8 | B | 8/1979 |
| SE | 1951070-0 | A1 | 4/2021 |
| WO | 2000049184 | A1 | 8/2000 |
| WO | 2008125726 | A1 | 10/2008 |
| WO | 2011012964 | A2 | 2/2011 |
| WO | 2012091422 | A2 | 7/2012 |
| WO | 2013045654 | A1 | 4/2013 |
| WO | 2014/040990 | A2 | 3/2014 |
| WO | 2020204795 | A1 | 10/2020 |
| WO | 2020204796 | A1 | 10/2020 |
| WO | 2020204797 | A1 | 10/2020 |
| WO | 2021061038 | A1 | 4/2021 |

OTHER PUBLICATIONS

Nuber, Dirk et al., "Circored fine ore direct reduction", Millennium Steel 2006, Raw Materials and Ironmaking, 2016, 4 pages.
Werther, Joachim, "Fluidized-Bed Reactors", Ullman's Encyclopedia of Industrial Chemistry, vol. 15, 2012, 48 pages.
Brazilian Office action from corresponding Application No. BR1120210192980, dated Feb. 11, 2025, 3 pages.
Australian Office action from corresponding Application No. 2020253206, dated Feb. 26, 2025, 4 pages.
Canadian Office action from corresponding Application No. 3173013, dated Mar. 3, 2025, 4 pages.
Brazilian Office action from corresponding Application No. BR1120210193030, dated Mar. 11, 2025, 3 pages.
Chinese Office action from corresponding Application No. 2021800454163, dated Mar. 18, 2025, 15 pages with translation.
Russian Office action from corresponding Application No. 2022134629, dated Mar. 28, 2025, 9 pages with translation.
Brazilian Office action from corresponding Application No. BR1120220041896, dated Apr. 15, 2025, 2 pages.
S.K. Kawatra et al.: "Single-Step Ironmaking from Ore to Improve Energy Efficiency", Final Technical Report; issue date Oct. 2005; 134 pages.
Thomas Battle et al.: "The Direct Reduction of Iron"; Treatise on process metallurgy, vol. 3; chapter 1 and 2; dated 2013; 88 pages.
Eiki Kasai et al.: "Future of Process Metallurgy"; Treatise on process metallurgy, vol. 3, chapter 4 and 5; dated 2013; 164 pages.
Roland Berger: "The future of steelmaking—How the European steel industry can achieve carbon neutrality"; Focus; dated May 2020; 16 pages.
Johannes Schenk: "Recent status of fluidized bed technologies for producing iron input materials for steelmaking"; Particuology 9(1); dated 2011; 10 pages.
B. Anameric et al.: "Properties and features of direct reduced iron"; Mineral Processing and Extractive Metallurgy Review, dated Jan. 2007; 60 pages.
Chatterjee et al.: "Sponge Iron Production and Direct Reduction of Iron Oxide"; Mineral Processing and Extractive Metallurgy Review; Gas-based Direct Reduction; dated 2012; 9 pages.
Reza Beheshti: "Sustainable Aluminium and Iron Production"; Doctoral Thesis; Royal Institute of Technology; dated 2017; 100 pages.
Satyendra: "Energiron direct reduction technology"; The Wayback Machine; dated 2019; acquired from Internet: website: https://web.archive.org/web/20190730224547/http://www.ispatguru.com:80/energiron-direct-reduction-technology/.
Valentin Vogl et al.: "Assessment of hydrogen direct reduction for fossil-free steelmaking"; Journal of Cleaner Production; dated 2018; 10 pages.
Communication pursuant to Rule 114(2) EPC from corresponding patent PCT/SE2021/050632; dated Jun. 9, 2023; 199 pages with translation.
Chilean Office Action from corresponding Application No. 202203724, dated Apr. 7, 2025, 30 pages with translation.
Office action from corresponding U.S. Appl. No. 18/864,429, dated May 1, 2025, 24 pages.
Korean Office Action from corresponding Application No. 10-2022-7009513, dated May 19, 2025, 19 pages with translation.
Japanese Office Action from corresponding Application No. 2022-578971, dated Jun. 3, 2025, 14 pages with translation.
Hernandez-Gomez, Roberto, et al., "Accurate Experimental (p,p,T) Data for the Introduction of Hydrogen into the Natural Gas Grid: Thermodynamic Characterization of the Nitrogen-Hydrogen Binary System from 240 to 350 K and Pressures up to 20 MPa", Journal of Chemical Engineering Data, (2017), pp. 4310-4326.
Office action from corresponding Russian Application No. 2023125309/05 dated Jun. 30, 2025, 16 pages with translation.
Office action from corresponding Application No. 2020356139 dated Jul. 11, 2025, 3 pages.
Office action from corresponding Application No. 2021800454163 dated Aug. 1, 2025, 15 pages with translation.
Office action from corresponding Application No. 202280021007.4 dated Aug. 16, 2025, 17 pages with translation.
Japanese Office action from corresponding Application No. 2023-555149, dated Sep. 8, 2025, 2 pages with translation.
"Administrative Nullity of Patent No. BR 11 2022 026372 4", dated Oct. 13, 2025, 69 pages.
Mexican Office action from corresponding Application No. MX/a/2022/003493, dated Sep. 26, 2025, 8 pages with translation.
Indian Office action from corresponding Application No. 202217021819, dated Nov. 21, 2025, 6 pages with translation.
Office Action from corresponding Application No. P00202308289 in Indonesia, dated Nov. 12, 2025, 6 pages with translation.
Indonesian Office Action from corresponding Application No. P00202214836 mailed on Oct. 30, 2025, 6 pages with translation.
Korean Office Action from corresponding Application No. 10-2023-7001056 mailed on Dec. 3, 2025, 16 pages with translation.

(56) References Cited

OTHER PUBLICATIONS

South African Written Opinion and Search Report from corresponding Application No. ZA2024/08872 mailed on Jan. 12, 2026, 9 pages.
Russian Office action from corresponding Application No. 2023125309 dated Nov. 28, 2025, 10 pages with translation.
European Search Report from corresponding Application No. 23808007.1 dated Jan. 21, 2026, 11 pages.
Office action from corresponding U.S. Appl. No. 18/864,429 dated Mar. 4, 2026, 39 pages.

* cited by examiner

METHOD AND DEVICE FOR PRODUCING DIRECT REDUCED METAL

The present invention relates to a method and a device for producing direct reduced metal, and in particular direct reduced iron (also known as sponge iron) with but with very low contents of carbon. In particular, the present invention relates to the direct reduction of metal ore under a controlled hydrogen atmosphere to produce such direct reduced metal. The invention can further be used to produce carburized such direct reduced metal, by the provision of a carbon-containing gas as a part of the same process for carburizing the reduced metal material.

The production of direct reduced metal using hydrogen as a reducing agent is well-known as such. For instance, in SE7406174-8 and SE7406175-5 methods are described in which a charge of metal ore is subjected to a hydrogen atmosphere flowing past the charge, which as a result is reduced to form direct reduced pure metal.

Furthermore, in Swedish applications SE1950403-4 and SE1951070-0, that have not been published at the priority date of the present application, processes for direct reducing metal material under a closed hydrogen atmosphere, and further to carburize such direct reduced metal material, are disclosed.

The present invention is particularly applicable in the case of batchwise charging and treatment of the material to be reduced.

There are several problems with the prior art, including efficiency regarding thermal losses as well as hydrogen gas usage. There is also a control problem, since it is necessary to measure when the reduction process has been finalized.

Furthermore, known methods for carburizing metal material include the use of carbon monoxide as a source of carburizing carbon. This leads to the production and release of carbon dioxide, and typically also to the production of carbon monoxide.

In the solutions described in the above mentioned Swedish patent applications, depending on the size of the furnace space and the amount of metal material to reduce, it may be desirable to increase downward transport of water into condensers of the type described in said patent applications.

Furthermore, said solutions use bodies of metal material to be reduced such as balls of such metal material. Forming such balls in some cases requires the use of excessive amounts of binding agents. When using granular material, the reduction process may result in individual granular particles breaking and contamination of the condenser with metal material.

It would hence be desirable to achieve a thermally and energy efficient method for direct reducing and carburizing of metal material that does not lead to the release into the atmosphere of carbon monoxide or carbon dioxide. The solution should be scalable to large throughputs and be capable of handling metal material of different constitutions.

The present invention solves the above described problems.

Hence, the invention relates to a method for producing direct reduced metal material, comprising the steps: a) charging metal material to be reduced into a furnace space; b) providing heat and a reducing gas into the furnace space, so that heated reducing gas heats the charged metal material to a temperature high enough so that metal oxides present in the charged metal material are reduced, in turn causing water vapour to be formed; and c) condensing and collecting the water vapour formed in step c in a condenser; which method is characterised in that, in step a), the metal material is charged onto a gas-permeable floor, in that the reducing gas is circulated in a closed loop upwards through said floor, through the charged metal material, and further via said condenser and a gas forced circulation device, and in that the method further comprises the step d) supplying additional reducing gas to achieve and/or maintain a predetermined pressure in said furnace space.

The invention also relates to a system for producing direct reduced metal material, comprising a furnace space, arranged to receive and accommodate metal material to be reduced; a heat and reducing gas provision means arranged to provide heat and reducing gas to the furnace space; a control device arranged to control the heat and reducing gas provision means so that heated reducing gas heats said charged metal material to a temperature high enough so that metal oxides present in the charged metal material are reduced, in turn causing water vapour to be formed; and a condenser, arranged to condense and collect the water vapour, which system is characterised in that the furnace space comprises a gas-permeable floor arranged to support the charged metal material as well as a gas forced circulation device, in that the heat and reducing gas provision means is arranged to circulate said reducing gas in a closed loop upwards through said floor, through the charged metal material, and further via said condenser and said gas forced circulation device, and in that the control device is arranged to control the heat and reducing gas provision means to supply additional reducing gas to achieve and/or maintain a predetermined pressure in said furnace space.

In the following, the invention will be described in detail, with reference to exemplifying embodiments of the invention and to the enclosed drawings, wherein:

FIG. 1*a* is a cross-section of a simplified furnace according to a first embodiment for use in a system according to the present invention and for use in a continuous process in a method according to the present invention;

FIG. 1*b* is a cross-section of a simplified furnace according to a second embodiment for use in a system according to the present invention and for use in a batch process in a method according to the present invention;

Figure 4A:
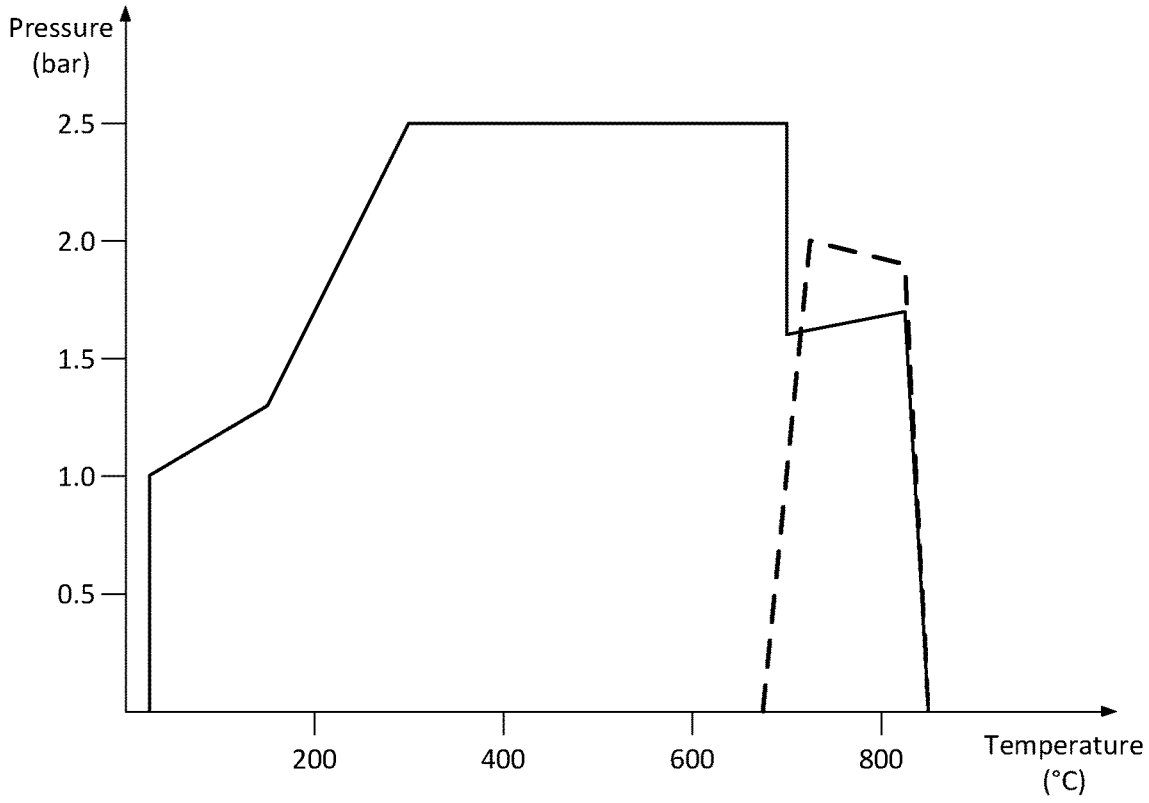
Figure 4B:
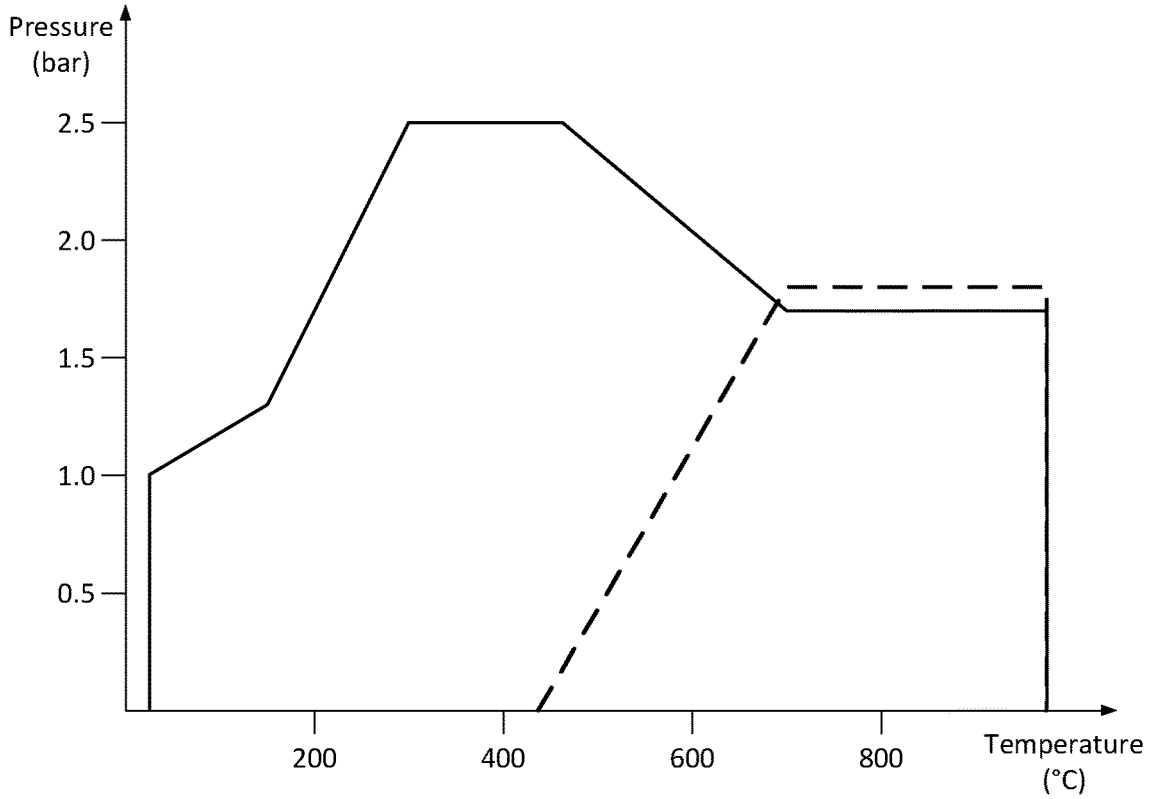
Figure 4C:
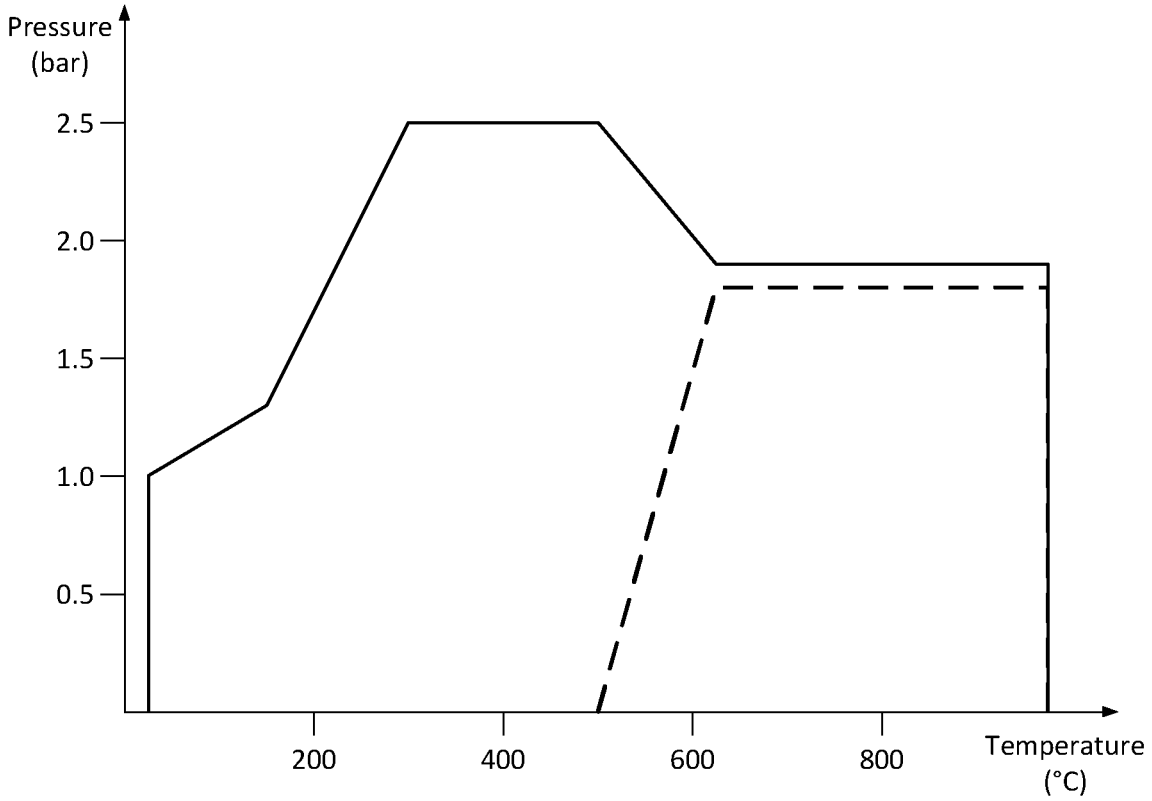
Figure 5:
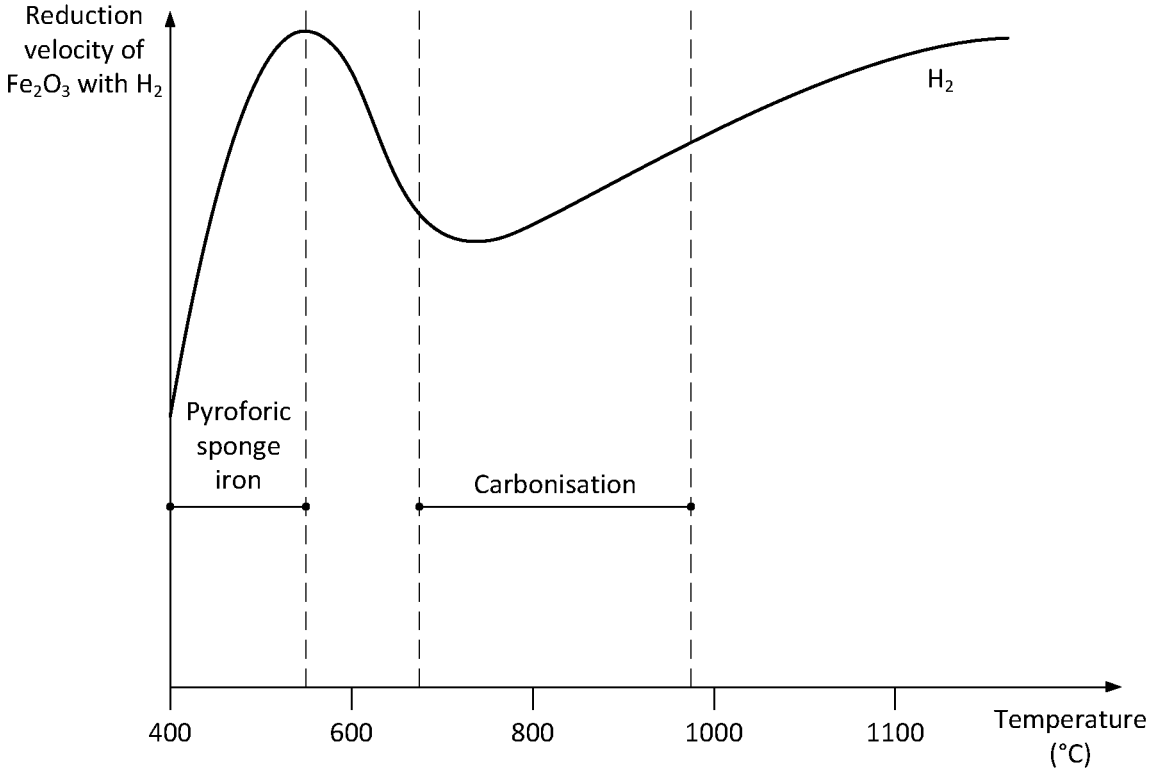
Figure 6:
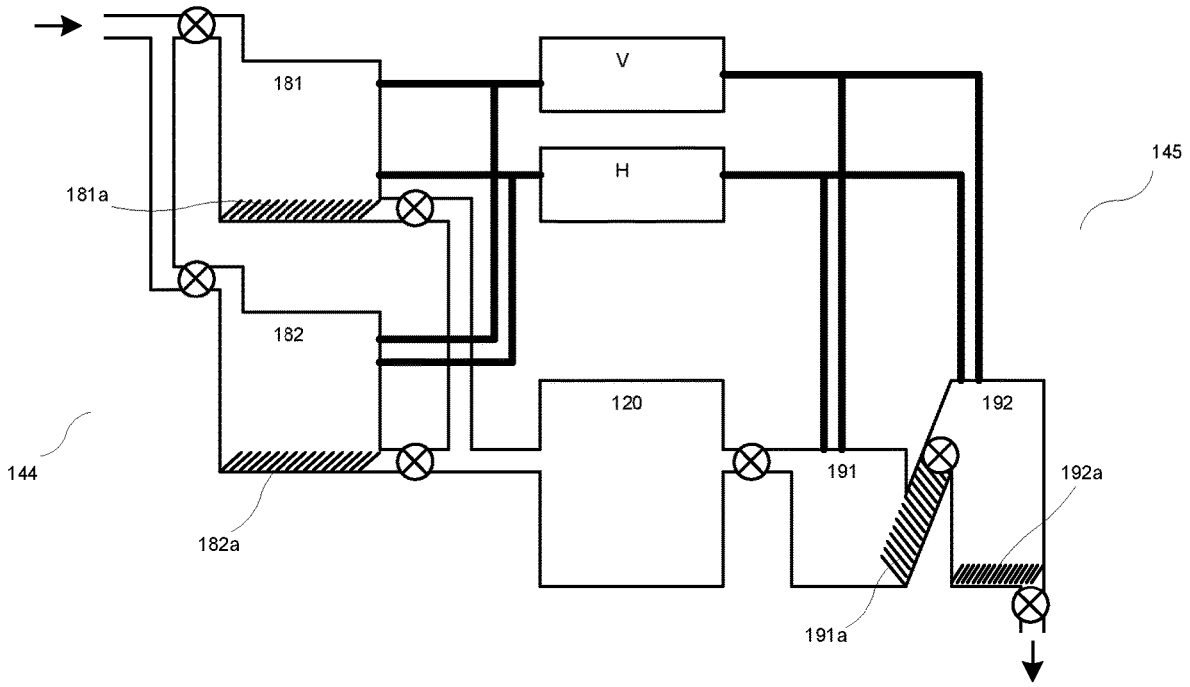

FIG. 4*a* is a schematic chart showing a possible relation between $H_2$ partial pressure, carburizing gas partial pressure and temperature in a heated furnace space according to a first embodiment of the present invention;

FIG. 4*b* is a schematic chart showing a possible relation between $H_2$ partial pressure, carburizing gas partial pressure and temperature in a heated furnace space according to a second embodiment of the present invention;

FIG. 4*c* is a schematic chart showing a possible relation between $H_2$ partial pressure, carburizing gas partial pressure and temperature in a heated furnace space according to a third embodiment of the present invention;

FIG. 5 is a chart showing the reductivity of $H_2$ with respect to a metal material to be reduced, as a function of temperature; and FIG. 6 is a schematic view of a charging and discharging mechanism for a continuous material processing according to the present invention.

Figure 1A:
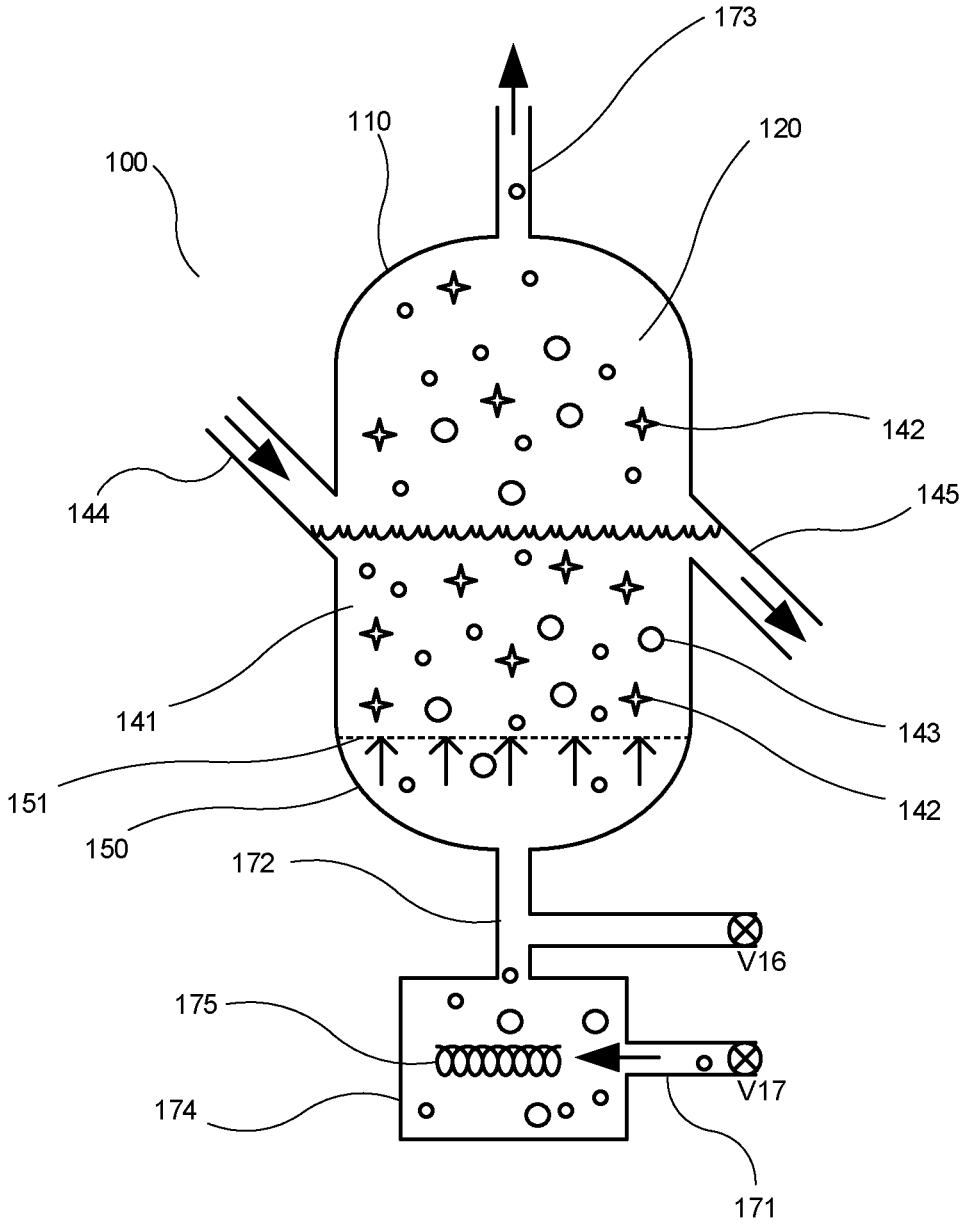
Figure 1B:
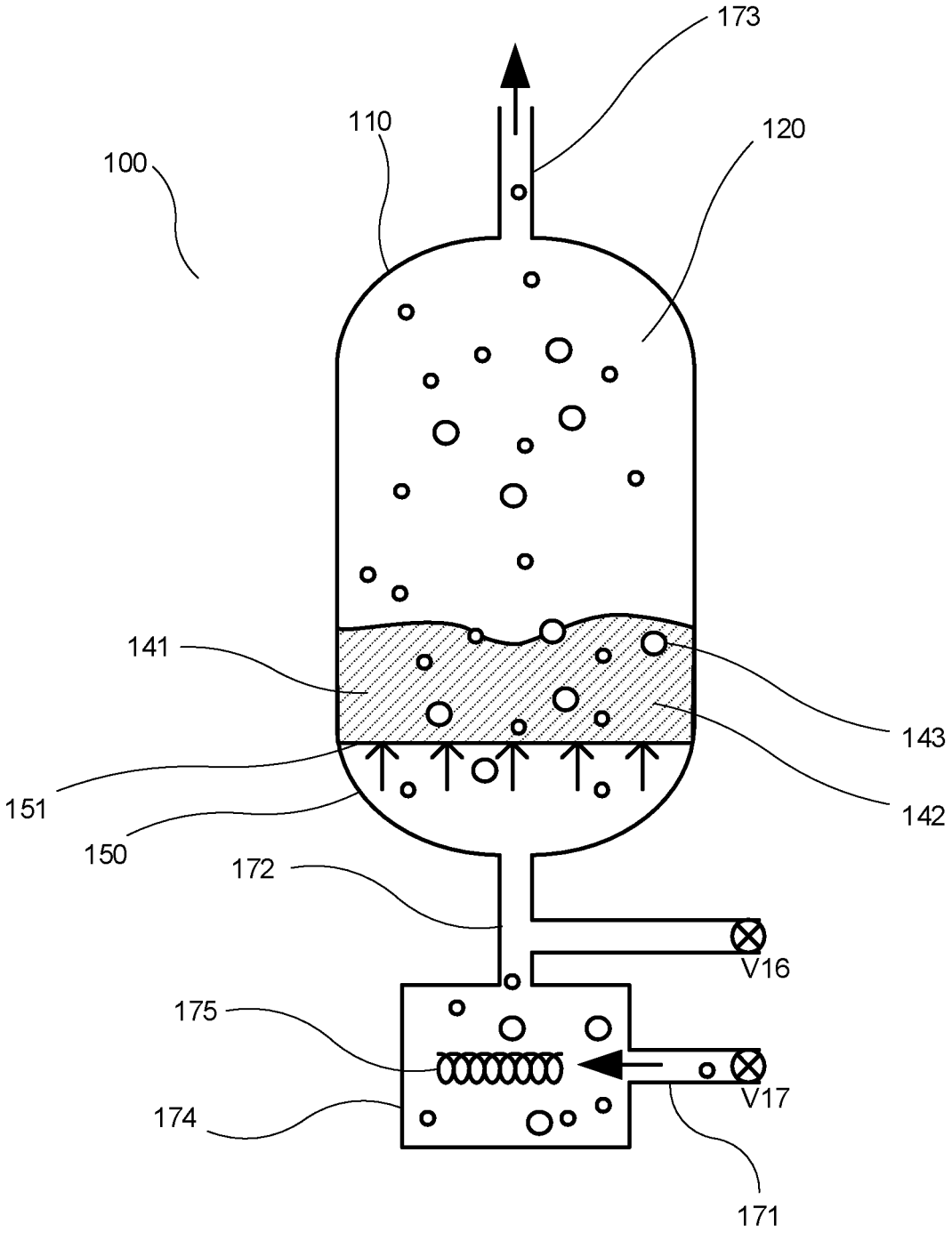

FIGS. 1*a*, 1*b* and 6 share reference numerals for corresponding parts.

Figure 2:
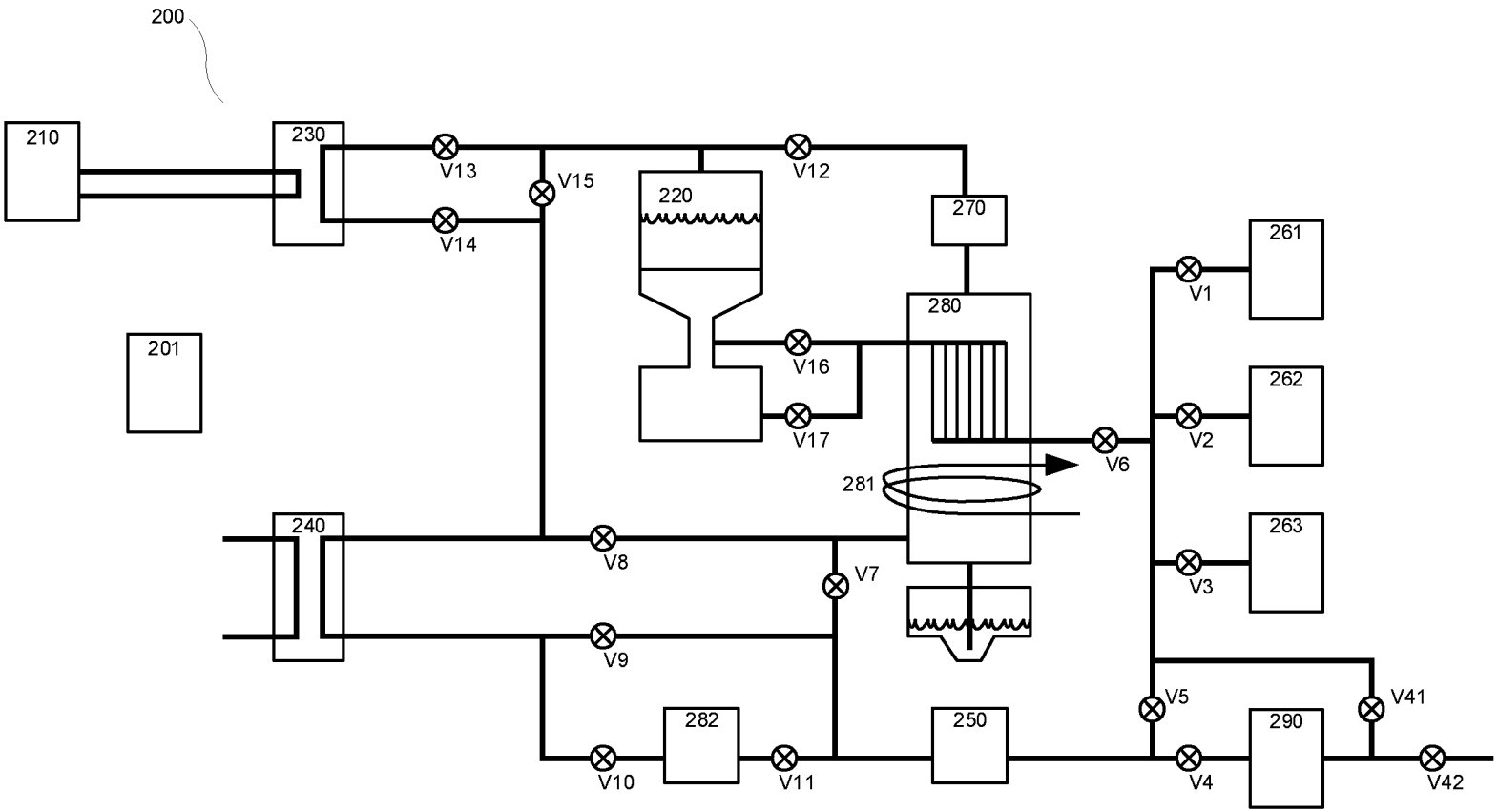
FIG. 2 is a schematic overview of a system according to the present invention.

Hence, FIGS. 1*a* and 1*b* each illustrates a respective furnace 100 for producing direct reduced and possibly carburized metal material. In FIG. 2, two such furnaces 210, 220 are illustrated. The furnaces 210, 220 may be identical to the furnace 100 illustrated either in FIG. 1*a* or FIG. 1*b*, or differ in details. However, it is understood that everything which is said herein regarding the furnace 100 is equally applicable to furnaces 210 and/or 220, and vice versa.

Furthermore, it is understood that everything which is said herein regarding the present method is equally applicable to the present system 200 and/or furnace 100; 210, 220, and vice versa.

As used herein, the term "metal material" is intended to encompass, depending on context, materials comprising metal. Hence, "metal material" to be reduced typically denotes metal oxide material; direct-reduced "metal material" typically denotes pure or substantially pure metal; and carburized "metal material" typically denotes carbon-containing metal material.

The furnace 100 is part of a closed furnace system comprising a heated furnace space 120 which is preferably arranged to be pressurized, such as to a pressure of more than 1 bar, such as to a pressure of at least 1.5 bar, or at least 2 bar, or at least 3 bar, or at least 4 bar, or at least 5 bar, or even at least 6 bar. At any rate, the furnace space 120 is built to withstand the operating pressures described herein. An upper part 110 of the furnace 100 may have a bell-shape.

The furnace 100 may be provided with one or more per se conventional doors (not shown) for charging and decharging of metal material 142 to be processed, which doors are then provided with gas-tight seals for gas-tight sealing when closed. Alternatively, the upper part 110 may itself be openable for charging of material to be processed, and may then be closable in a gas-tight manner using fastening means (not shown).

The furnace space 120 may be interiorly encapsulated with refractory material, such as brick material.

If nothing else is said, the term "pressure" herein refers to a total gas pressure, in particular inside the furnace space 120, in contrast to a "partial pressure" referring to the partial gas pressure of a particular gas.

Furthermore, since atmospheric pressure is about 1 bar, the expression "pressure of more than 1 bar" and "pressure above atmospheric pressure" is intended to have the same meaning. Correspondingly, the expression "pressure of less than 1 bar" and "pressure below atmospheric pressure" is intended to have the same meaning.

The furnace space 120 is arranged to be heated using one or several heating elements 175, preferably located in a gas heating device 174 which will be described below. Preferably, the heating elements 175 are electric heating elements. However, radiator combustion tubes or similar fuel-heated elements can be used as well. The heating elements 175 do not, however, preferably produce any combustion gases that interact directly chemically with the furnace space 120 or the rest of said closed furnace system in which the gas is circulated (see below), which closed furnace system preferably is kept chemically controlled for the present purposes.

In general, the furnace 100 may comprise a volume (in the case illustrated in FIGS. 1*a* and 1*b* inside heating device 174) upstream, such as beneath, the gas-permeable floor 151 through which the reducing gas passes on its way to the fluidised bed 141, and in that the reducing gas is heated in this volume. Separately heating the gas to be supplied to the furnace space 120 in a closed loop this way makes it possible to achieve a more rapid heating of the metal material 142.

It is preferred that the only gaseous matter provided into the furnace space 120 during the below-described main heating process is inert and/or hydrogen gas, and any carbon-containing gas used as a carbon source for carburizing the reduced metal material 142.

The heating elements 175 may preferably be made of a heat-resistant metal material, such as a molybdenum alloy.

Additional heating elements may also be arranged in the heated furnace space 120, which additional heating elements may be similar to heating elements 175. Such heating elements may aid heating not only the gas, but also the charged material via heat radiation.

The furnace 100 may furthermore comprise a lower part 150, forming a sealed container together with the upper part 110, permanently or when the furnace is sealingly closed using fastening means as described above.

Hence, the furnace space 120 is arranged to receive and accommodate metal material 142 to be reduced. The furnace 100 furthermore comprises a heat and reducing gas provision means 174, 175, 250, arranged to provide heat and reducing gas to the furnace space 120 as discussed above.

The "heat and reducing gas provision means" may be any apparatus arranged to provide both thermal energy and reducing gas to the furnace space 120. In contrast to the solutions described in SE1950403-4, according to the present invention the reducing gas is circulated through the furnace space 120 in a closed loop (the above-mentioned closed furnace system). To this end, the heat and reducing gas provision means may comprise a gas forced circulation device (also denoted "gas propulsion device" herein), such as a fan or compressor 250 to propel the reducing gas in said closed loop by the creation of a pressure difference across the circulation device 250. The thermal energy may be supplied to the furnace space 120 indirectly, by heating the reducing gas in the gas heating device 174, which in turn may be a space through which the reducing gas is propelled as a part of said closed loop and containing gas heating apparatus 174. The heat and reducing gas provision means may also comprise a separate pressurized reducing gas provision means, such as a regulated supply from a source of highly pressurized source of reducing gas and/or a separate compressor. The corresponding is true for any carburization gas used (see below).

Moreover, the system 200 comprises a control device 201, arranged to control said heat and reducing gas provision means 174, 175, 250 so that heated reducing gas heats said charged metal material 142 to a temperature high enough so that metal oxides present in the charged metal material 142 are reduced, in turn causing water vapour to be formed.

The system 200 furthermore comprises a condenser 280, arranged to condense and collect water vapour formed as a result of evaporation of any water contained in the charged metal material 142 and as a result of the reduction reactions described herein. The condenser 280 may comprise a gas-gas type heat exchanger, which may advantageously be a tube heat exchanger such as is known per se, and which may transfer thermal energy, by heat exchange, from a reducing gas flow through said closed loop downstream of the furnace space 120 to a reducing gas flow through said closed loop upstream of the furnace space 120. Such a heat exchanger may furthermore be a counter-flow type heat exchanger. To the condenser 280, such as to said heat exchanger of the condenser 280, such as below said heat exchanger, there may be connected a closed trough for collecting and accommodating condensed water from the heat condenser 280. The trough may also be constructed to withstand the operating pressures of the furnace space 120 in a gas-tight manner.

The condenser 280 is connected to the furnace space 120, preferably so that cool/cooled gases pass the condenser 280, and in particular said heat exchanger of the condenser 280, along externally/peripherally provided heat exchanger tubes and further through a channel via valve V17 to the heating apparatus 174. Then, heated gases passing out from the furnace space 120, after passing and heating the charged material 142 (see below), again pass the condenser 280, such as through internally/centrally provided heat exchanger tubes thereby heating said cool/cooled gases. The outgoing gases from the furnace space 120 hence heat said incoming cool/cooled gases both by thermal transfer due to the temperature difference between the two, as well as by the condensing heat of water vapour contained in the outgoing gases being condensed effectively heating the incoming cool/cooled gases.

The condenser 280 may also comprise an optional liquid-to-gas heat exchanger 281 for cooling the reducing gas further using a circulating cooling liquid such as water. Hence, the liquid-to-gas heat exchanger 281 may be in the form of water pipes being arranged in thermal contact with the reducing gas to be cooled.

The formed condensed water from the outgoing gases is collected in said trough.

The furnace 100 may comprise a set of temperature and/or pressure sensors in the trough; at the bottom of the furnace space 120, such as below the floor 151 (see below) and/or at the top of the furnace space 120. These sensors may be used by control unit 201 to control the reduction and/or carburizing process, as will be described below.

Condensed water may be led from the condenser 280 down into the trough via a spout or similar, debouching at a bottom of the trough, such as at a local low point of the trough, preferably so that an orifice of said spout is arranged fully below a main bottom of the trough such as is illustrated in a simplified manner in FIG. 2. This will decrease liquid water turbulence in the trough, providing more controllable operation conditions.

The trough may be dimensioned to be able to receive and accommodate all water formed during the reduction of the charged material. The size of trough can hence be adapted for the type and volume of one batch of reduced material. For instance, when fully reducing and 1000 kg of $Fe_3O_4$, 310 liters of water is formed as a result, and when fully reducing 1000 kg of $Fe_2O_3$, 338 liters of water is formed as a result. However, the trough may also be arranged with an emptying mechanism, comprising a valve allowing the complete or partial emptying of the trough from water during the reducing process while maintaining a desired overpressure in said closed loop as described below.

According to the present invention, the furnace space 120 comprises a gas-permeable floor 151, arranged to support the charged metal material 142 as well as said gas forced circulation device 250.

Furthermore according to the present invention, the heat and reducing gas provision means 174, 250 is arranged to circulate said reducing gas in said closed loop upwards through said floor 151, through the charged metal material 142, and further via said condenser 280 and said gas forced circulation device 250. It is realized that the condenser 280 and gas forced circulation device 250 may be arranged in any order, but that it is preferred that the condenser 280 is arranged upstream of said gas force circulation device 250 in relation to the furnace space 120 in said closed loop.

Further according to the invention, the control device 201 is arranged to control the heat and reducing gas provision means 174, 250 to supply additional reducing gas to achieve and/or maintain a predetermined pressure in said furnace space 120.

As mentioned above, in FIG. 2 a system 200 is illustrated in which a furnace of the type illustrated in FIGS. 1*a* and 1*b* may be put to use. In particular, one or both of furnaces 210 and 220 may be of the type illustrated in FIGS. 1*a* and 1*b*, or at least according to the present claim 1.

230 denotes a gas-gas type heat exchanger. 240 denotes a gas-liquid type heat exchanger, such as a gas-water heat exchanger. 261 denotes a storage container for or supply of $N_2$ or another inert gas, such as Ar or He. 262 denotes a storage container for or supply of $H_2$ or another reducing gas. 263 denotes a storage container for or supply of $CH_4$ or another carburizing gas. 270 denotes a cyclone separator, or any other device suitable for separating out residual solid-state metal material entrained with the gases flowing out from the furnace space 120. 282 denotes a gas dryer, such as any conventional adsorption, cooling or membrane type gas dryer for further reduction of the water content and 290 denotes a pump, such as a vacuum pump. The pump 290 is operated to evacuate the system, by opening valves V4 and V42 while closing valve V41.

The above-mentioned control device 201 is connected to any sensors used, and also to valves V1-V17 to control said valves V1-V17 and thereby the gas flow in the various conduits illustrated in FIG. 2. The control device 201 is generally arranged to control the processes described herein. The control device 201 may also be connected to a user control device, such as a graphical user interface presented by a computer (not shown) to a user of the system 200 for supervision and further control.

Figure 3:
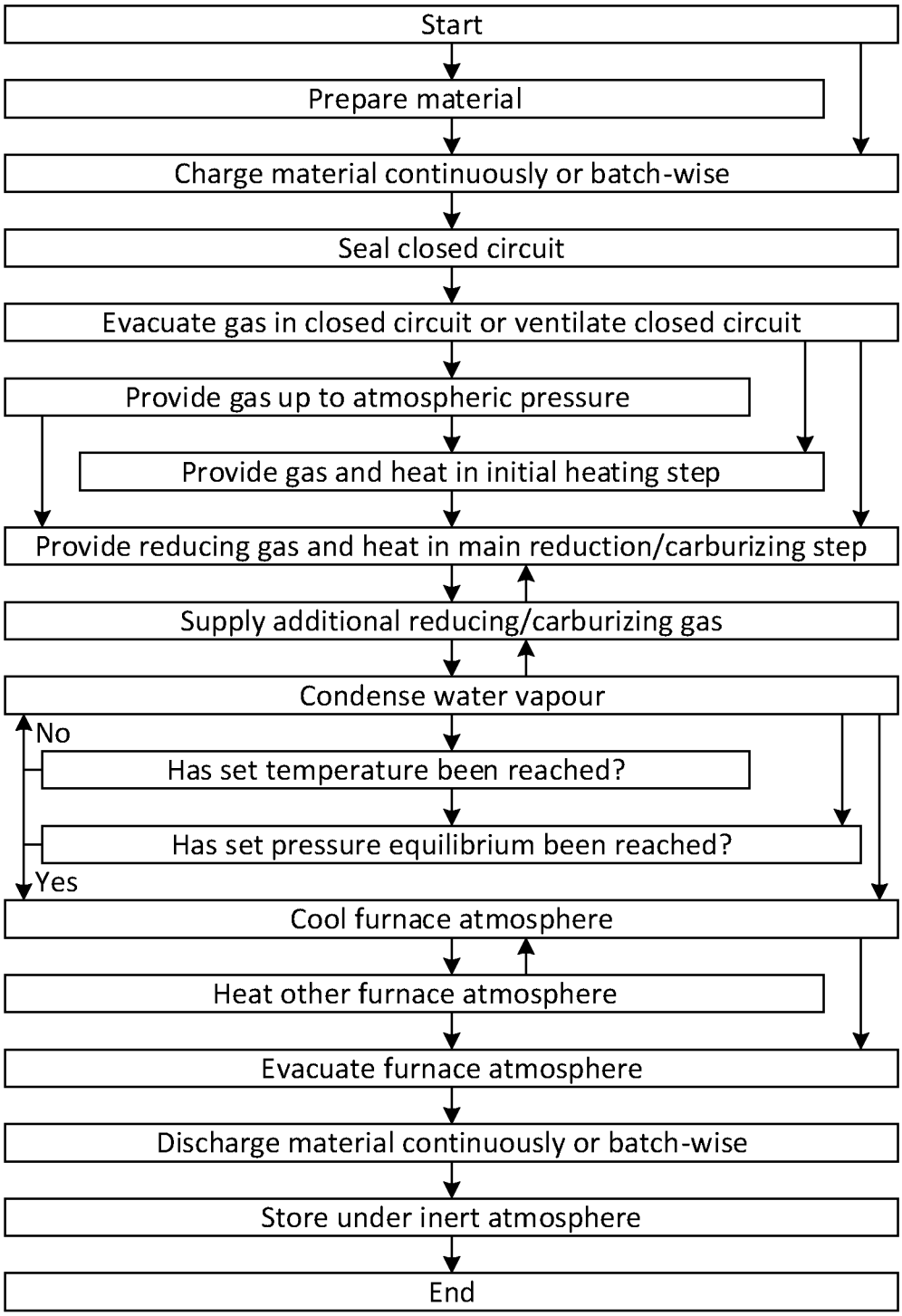
FIG. 3 is a flowchart of a method according to the present invention.

FIG. 3 illustrates a method according to the present invention, which method uses a system 100 of the type generally illustrated in FIG. 2 and in particular a furnace 100 of either one of the types generally illustrated in FIGS. 1*a* and 1*b*. In particular, the method is for producing direct reduced and possibly carburized metal material using a gaseous reducing agent gas and possibly a carbon-containing gas as the carburizing carbon source.

The reducing gas may be hydrogen gas or any other reducing gas, such as a gaseous hydrocarbon Hereinafter, hydrogen gas will be used as an example of a reducing gas.

After such direct reduction and possible carburizing, the metal material 142 may form pure or substantially pure metal, or after carburizing may form "sponge" metal. In particular, the metal material may be iron oxide material, and the resulting product after the direct reduction may then be pure iron which may be carburized to "sponge" iron. The resulting reduced, possibly carburized metal material may then be used, in subsequent method steps, to produce cast iron, steel and so forth.

It is noted that the carburization described herein will typically result in an increased carbon content at and near a surface of the carburized material, which may otherwise be very low in carbon.

The charged metal material can comprise or be entirely constituted by scale, grinding residues and/or iron or other metal ores.

In a first step, the method starts.

In a possible subsequent material provision step, the metal material 142 to be reduced is grinded, crushed, and/or sifted to form a granular material having a desired grain size. Preferably, the material 142 is processed to be in a powder form, having a mean particle size which is at least 1 μm, such as at least 5 μm, such as at least 10 μm, such as at least 50 μm, such as at least 150 μm, and at the most 20000 μm, such as at the most 10000 μm, such as at the most 5000 μm. Alternatively or additionally, in particular in case the metal material 142 already is of granular constitution, larger balls or pellets are formed of said metal material 142, for instance by pressing it into bodies of desired shape and size, such as with a suitable amount of water or other binding agent present as binder. Such larger balls or pellets may be at least 1 mm, such as at least 3 mm, and at the most 100 mm, such as at the most 50 mm, such as at the most 20 mm, such as at the most 10 mm, of average particle size.

As an alternative, the metal material 142 may be provided in the form of larger bodies, or granular material having larger grain size than for a powder. Such larger bodies may be at least 0.5 mm, preferably at least 2 mm, and at the most 100, preferably at the most 50, preferably at the most 10 mm, of average particle size.

In case the metal material 142 is provided in the form of a powder, a fluidised bed 141 of the type illustrated in FIG. 1*a* (which is a "Bubbling Fluidized Bed Reactor", BFBR) has proven useful. In a fluidised bed, the reaction surface between the metal material 142 and used reduction/carburizing gasses becomes very large, resulting in rapid and efficient reactions. As an alternative, a "Circulation Fluidized Bed Reactor" (CFBR) may be used. This case is illustrated in FIG. 1*b*. It is realized that both FIG. 1*a* and FIG. 1*b* are simplified in terms of how the fluidized bed is illustrated.

In the case the metal material 142 is provided not as a powder but with larger particle sizes (such as said balls, pellets or bodies), it is preferred not to use a fluidised bed at all, but to treat the metal material 142 with heated reducing gas penetrating a bed of metal material 142 from beneath.

In fluidized beds of said CFBR/BFBR types, particle movement is such that heavier particles have a tendency to move to the bottom and lighter particles have a tendency to move to the top of the bed. During the reduction process, the particles in question get lighter over time, and as a result move to the top of the bed.

Such a material preparation step may advantageously be performed in direct connection to the reducing of the metal material, such that the entire process including both material preparation and reduction takes place in one connected process at one and the same physical premises.

In a subsequent step, the metal material 142 to be reduced is charged into the furnace space 120. This charging may take place continuously, as exemplified in FIG. 1*a*, or the process may be formed in a batch-wise manner, as exemplified in FIG. 1*b*. This will be described in detail below. As a result of the charging, the charged metal material 142 will be arranged inside the furnace space 120, which in turn forms part of a closed gas circuit as described above, which circuit is closed and sealed in a gas-tight manner so as to allow an overpressure to be achieved and maintained therein.

In a subsequent step, an existing atmosphere may be evacuated from the furnace space 120, and preferably from the entire closed circuit, so that a gas pressure of less than 1 bar is achieved therein. It is noted that this lower gas pressure is then lower than atmospheric pressure. This may take place by valves V1-V3, V41 being closed and valves V4-V9, V12, V15-V17, V42 being opened. The pump 290 then sucks out and hence evacuates the contained atmosphere inside the furnace space 120 and the entire closed loop via the conduit passing valve V42 into the surrounding atmosphere. In case the furnace space 120 and the closed loop is not filled with air, but with used hydrogen and/or carbon-containing gas, this gas may instead be evacuated to the container 262 or 263, as the case may be, by properly setting valves V1-V5, V41-V42.

In this evacuation step, as well as in other steps as described below, the control device 201 may be used to control the pressure in the furnace space 120 and/or at other locations in said closed loop comprising the furnace 220, the separator 270, the condenser 280 and the forced circulation device 250, such as based upon readings from available pressure sensors.

The emptying may proceed until a pressure of at the most 0.5 bar, preferably at the most 0.3 bar, is achieved in the furnace space 120 or in the entire closed circuit of which the furnace space 120 forms a part.

As an alternative to this evacuation step, the furnace space 120 and the entire closed loop may be ventilated by an inert gas, such as $N_2$ from container 261. Then, atmospheric pressure may be maintained throughout this ventilation step.

In a subsequent initial heating step, heat and hydrogen gas is provided to the furnace space 120. In this initial heating step, either the reducing gas or an inert gas may be circulated through the charged metal material 142 to heat the charged metal material 142. Then, the method may comprise a second reduction and possible carburization step, in which the reducing gas is circulated through the charged metal material to achieve reduction of the charged metal material 142.

In both steps, the hydrogen gas may be supplied from container 262. Since said closed loop is closed in a gas-tight manner, as mentioned above, substantially none of the provided hydrogen gas will escape during the process. In other words, the hydrogen gas losses (apart from hydrogen consumed in the reduction reaction) will be very low or even non-existent. Instead, only the hydrogen consumed chemically in the reduction reaction during the reduction process will be used. Further, the only hydrogen gas which is required during the reduction process is the necessary amount to uphold the necessary pressure and chemical equilibrium between hydrogen gas and water vapour during the reduction process.

The hydrogen container 262 may be arranged to hold and provide both fresh and used/reused hydrogen gas. For instance, this may be realized by providing two different hydrogen gas containers, together with suitable valves. Such "used" hydrogen gas is hydrogen gas that has already been used in one or several reduction steps and has since been collected in the system 200. The first time the reduction process is performed, only fresh hydrogen gas is then used, provided from the container in question. During subsequent reduction processes, reused hydrogen gas, from the container in question is used, which is topped up by fresh hydrogen gas according to need. The corresponding may or may not be true with respect to the inert gas container 261 and/or the carbon-containing gas container 263.

As an alternative to hydrogen gas, during the initial heating step inert gas may be provided to the closed loop instead. This may be achieved by valve V1 being opened instead of valve V2, and valves V4, V16 and V42 being closed.

Thereafter, such as when a predetermined pressure, such as a predetermined pressure between 1 and 2 bars, is reached, heating elements 175 are switched on and the forced circulation device 250 is started; valves V7 and V15 are closed and the liquid-to-gas heat exchanger 281 in the condenser 280 may be provided with a flow of cooling liquid, such as cooling water. The gas will then circulate in the closed loop via the forced circulation device 250 and valves V5, V6, further through the gas-gas heat exchanger in the condenser 280 (where it is preheated by gases arriving from the furnace space 120), further via valve V17 into the gas heating device 174, where it is heated by heating elements 175. Thereafter, the gas enters the bottom 150 of the furnace 100 where it is evenly distributed across the floor 151 in a gas distribution chamber, through which it flows in an upwards direction, past the metal material 142 to be reduced. The gas will thereafter continue in the closed loop, via valve v12 and the separator 270, wherein any entrained metal material 142 will be separated from the gas, through the condenser 280, past said gas-gas heat exchanger and the liquid-gas heat exchanger (if used), thereby releasing entrained water vapour as a result of cooling by said heat exchange, and finally back to the forced circulation device 250 via valves V7 and/or V8. This closed circuit circulation is controlled using valves V1-V42 as controlled by the control unit 201.

The heat from the heated gas from the furnace 220 will cause any contained water in the metal material 142 to evaporate. Later, when the temperature increases (see below), the reduction of the metal material 142 caused by the reducing properties of the reduction gas flowing past the metal material 142 in an upwards direction will also produce water in the form of water vapour. The formed water vapour is swept away by the flowing reducing gas and is condensed out in the condenser 280, by said heat exchange cooling, and collected in said trough. Optionally, additional drying of the gas circulated in the closed loop can be performed in dryer 282, by opening valves V10 and V11 so that the gas passes the switched on dryer 282.

In general, the reducing gas may be preheated in a heat exchanger, which heat exchanger is arranged to transfer thermal energy from water evaporated from the charged metal material 142 to the reducing gas to be provided to the furnace space 120 via the floor 151.

Hence, during this initial heating step, the control device 201 is arranged to control the heat and reducing gas provision means 274, 275, 250 to provide heat and reducing gas (or, alternatively, heat and inert gas) to the furnace space 120 in a way so that heated gas heats the charged metal material 142 to a temperature above the boiling temperature of water contained in the metal material 142. As a result, said contained water evaporates.

Throughout the initial heating step and the main reduction step (see below), additional gas is supplied to the closed loop slowly, under the control of the control device 201, to achieve and maintain a desired pressure in the closed loop and in particular in the furnace space 120. In general, the control device 201 is arranged to continuously add gas so as to maintain a desired increasing (such as monotonically increasing) gas pressure curve, such as a desired increasing hydrogen partial pressure curve, (and also a total pressure curve) in the closed loop and in particular inside the furnace space 120. The provision of additional gas is also performed to counteract the decreased pressure resulting from the condensation of water vapour in the absorber 280.

It is preferred that the cold hydrogen and/or inert gas supplied to the heat exchanger of the condenser 280, and also any carbon-containing gas supplied thereto, is room tempered or has a temperature which is slightly less than room temperature.

It is realized that this initial heating step, in which the charged material 142 is hence dried from any contained liquid water, is a preferred step in the present method. In particular, this makes it easy to produce and provide the charged material 142 as a granular material as described above, such as in the form of rolled balls of material, without having to introduce an expensive and complicating drying step prior to charging of the material into the furnace space 120.

However, it is realized that it would be possible to charge already dry or dried material into the furnace space 120. In this case, the initial heating step as described herein would not be performed, but the method would skip immediately to the main reduction and carburization step (below).

Moreover, the mechanisms of this initial heating step, having been described above with reference to added hydrogen and/or inert gas, may also be applied in the subsequent main reduction and possible carburization step. However, in the initial heating step it is preferred that no carbon-containing gas is added. In particular, it is preferred that the only added gas during the initial heating step is reducing gas and/or inert gas.

In one embodiment of the present invention, the provision of gas to the furnace space 120 during said initial heating step is controlled to be so slow so that a pressure equilibrium is substantially maintained throughout the performance of the initial heating step, preferably so that a substantially equal pressure prevails throughout the furnace space 120, and possibly in the entire closed loop, at all times. In particular, the supply of gas may be controlled so that the said equilibrium gas pressure does not increase, or only increases insignificantly, during the initial heating step. In this case, the gas supply is then controlled to increase the furnace space 120 pressure over time only after all or substantially all liquid water has evaporated from the charged material 142. The point in time when this has occurred may, for instance, be determined as a change upwards in slope of a temperature-to-time curve as measured by said temperature sensors, where the change of slope marks a point at which substantially all liquid water has evaporated but the reduction has not yet started. Alternatively, gas supply may be controlled so as to increase the pressure once a measured temperature in the furnace space 120 has exceeded a predetermined limit, which limit may be between 100° C. and 150° C., such as between 120° C. and 130° C.

In a subsequent main reduction and possible carburization step, heat and hydrogen gas is further provided to the furnace space 120, in a manner corresponding to the supply during the initial heating step described above, so that heated hydrogen gas heats the charged metal material 142 to a temperature high enough in order for metal oxides present in the metal material 142 to be reduced, in turn causing water vapour to be formed.

As mentioned above, this water vapour is condensed and collected in said condenser 280.

As also mentioned above, according to the present invention the metal material 142 is charged onto the gas-permeable floor 151, and the reducing gas is circulated in the closed loop upwards through the floor 151, through the charged metal material 142, and further via said condenser 280 and the gas forced circulation device 250.

The present method further comprises the step, such as performed during a main reduction and possible carburization step, of supplying additional reducing gas to achieve and/or maintain a predetermined pressure in said closed loop.

During this main reduction and possible carburization step, additional hydrogen gas is hence supplied and heated, under a gradual pressure increase inside the furnace space 120, so that the charged metal material 142 in turn is heated up to a temperature at which a reduction chemical reaction is initiated and maintained.

In the exemplifying case of $Fe_2O_3$ as the metal material 142 to be reduced, the theoretical energy needed to heat the oxide, thermally compensate for the endothermic reaction and reduce the oxide is about 250 kWh per 1000 kg of $Fe_2O_3$. For $Fe_3O_4$, the corresponding number is about 260 kWh per 1000 kg of $Fe_3O_4$.

In the case of iron oxide material and hydrogen gas as the reducing gas, the hydrogen gas will start reducing the charged material to form metallic iron at about 350-400° C., forming pyrophoric iron and water vapour according to the following formulae:

$$Fe_2O_3 + 3H_2 = 2Fe + 3H_2O$$

$$Fe_3O_4 + 4H_2 = 3Fe + 4H_2O$$

This reaction is endothermal, and is driven by the thermal energy supplied via the hot hydrogen gas flowing through the metal material 142 from below, through the gas-permeable floor 151 and on past/through the charged material 142 in the furnace space 120.

Hence, during both the initial heating step and the main reduction and possible carburization step, water vapour is produced in the charged material 142. This formed water vapour is continuously condensed and collected in the condenser 280.

The material to be processed comprises a metal oxide, preferably an iron oxide such as $Fe_2O_3$ and/or $Fe_3O_4$. If such iron ore additionally contains oxides that evaporate at temperatures below the final temperature of the charged material in the present method, such oxides may be condensed in the condenser 280 and easily collected in powder form. Such oxides may comprise metal oxides such as Zn and Pb oxides.

In one embodiment of the present invention, the flow of the reducing gas upwards through said floor 151 and further through the charged metal material 142 is arranged so that the charged metal material 142 together with said reducing gas forms a fluidised bed 141. This is illustrated in FIGS. 1*a* and 1*b*. The reducing gas enters into the gas heating device via conduit 171, is heated by the heating element 175 and is thereafter provided to the lower part 150 of the furnace space 120 via conduit 172. In the lower part 150, the reducing gas is distributed evenly across the gas-permeable floor 151 through which it is pressed in an upwards direction to mix with the charged material 142.

The floor 151 may advantageously comprise a perforated plate (constriction plate), such as a ceramic plate, or be of woven heat-resistant material, such as woven from metal threads.

Depending on the objectives and the type of metal material 142, the fluidised bed 141 may be a so-called "bubbling bed" (BFBR, above), in which the charged metal material 142 stays on said gas-permeable floor 151, on which it is supported as the gas flows past it 143, upwards. This means that the fluidised bed 141 (the mixture of metal material 142 and upwards flowing reducing gas) at least partly behaves like a liquid contained in the furnace space 120 and on the floor 151.

Alternatively, the fluidised bed 141 may be a so-called "circulating bed" (CFBR, above), in which the charged metal material 142 is not at all, substantially not at all, or at least not entirely, supported on the floor 151, but is instead at least partly, such as completely or at least substantially completely, suspended above the floor 151, inside said furnace space 120, by the flowing gas 143. This means that the fluidised bed 141 instead at least partly behaves like a gas, filling at least a lower part of the volume in the furnace space 120 located above the floor 151.

In both these cases, the metal material 142 may advantageously be charged into the furnace space 120 (onto the floor 151) via one input 144 and discharged therefrom via a different output 145. The output 145 may be located at a height from where the metal material 142 can be discharged during fluidised bed 141 operation, in other words when the metal material 142 is at least partly elevated, by the suspension or expansion provided by the gas flowing through it. If the fluidised bed 141 has an upper surface with a mean height during operation, the output 145 is hence preferably arranged below such a mean height.

It is understood that the properties of the fluidised bed in terms of gas throughput and type of fluidisation is determined based on, inter alia, the size and shape of the furnace space 120, the properties of the floor 151 and the capacity and operation of the propulsion device 250, all being in relation to the properties and amount of the charged metal material 142. Hence, the propulsion device 250 propels the gas through the fluidised bed 141. Of course, additional fans etc. can be arranged to aid this propulsion.

The fact that the gasses flow past the material in an upwards direction results in that any loose metal material 142 will be brought upwards. In the case of metal powder, this includes particles straying out from the furnace space 120. In the case of larger metal bodies, this includes small particulate matter coming loose from such larger bodies, for instance as a result of pressure from metal bodies arranged on top of such bodies and/or from the reduction and/or carburizing reactions described herein. In the latter case, such particles would risk falling down and clogging the gas passage unless brought with the flowing gas upwards. In all cases, such stray particles may be efficiently captured by the separator 270.

Even with larger bodies of metal material, the upwards-flowing gas will also decrease the pressure on lower bodies resulting from higher bodies, increasing the reaction surfaces available for reducing/carburizing reactions.

Then, the metal material 142 may be continuously charged into furnace space 120, via the input 144. Furthermore, reduced (and possibly carburized) material may be continuously discharged from furnace space 120 for transport and/or additional processing. This way, a fully continuous processing may be achieved, where metal material 142 to be reduced and possibly carburized is continuously charged, and reduced/carburized material is continuously discharged, while reducing (and possibly carburizing) gas is continuously added as required by its consumption in the chemical process. It is realized that the process can be cycled, such as switching between charging-reduction-carburizing-discharging-charging—etc., while still being "continuous" in the sense that the process is not stopped and the furnace space 120 opened between cycles. Alternatively, the process can be completely continuous, by maintaining a predetermined, constant temperature and reducing/carburizing gas pressure inside the furnace space 120, while the metal material 120 is continuously charged at the input 144 and discharged at the output 145, between which ports 144, 145 it is transported as a result of the movements of the fluidised bed 141. In this case, the floor 151 can be slanting from the input 144 towards the output 145, or the movement of the metal material 142 may be entirely energized by the gas 143, in turn being propelled by the propulsion device 250.

It is noted that for completely continuous processes, the initial step and the main step as described herein will be one single step, both heating the charged material 142 and reducing it (and possibly carburizing it) by the provision of said heat and gasses.

In a continuous process, the condensed water needs to be discharged, continuously or intermittently, from the condenser 280. This may take place, for instance, using a check valve of similar per se conventional device for releasing water without lowering the pressure in the closed loop more than corresponding to the released volume of water.

FIG. 6 illustrates a setup for charging and discharging metal material 142 in relation to the furnace space 120. The input 144 may comprise at least one, preferably at least two input collectors 181, 182 for material to be reduced, arranged to deliver such material to the furnace space 120. In case there are more than one such collector 181, 182, they are preferably arranged in parallel, for alternating use so that one such collector 181, 182 is charged with new material while the other delivers its material into the furnace space 120.

The output 145 may further comprise a first output collector 191, arranged to receive reduced metal material from the furnace space 120. The output 145 may also comprise a second output collector 192, which is connected in series to the first output collector 191, downstream of the first output collector 191.

Each of the collectors 181, 182, 191, 192 can be sealed in a gas-tight manner using valves (shown as circles with an "X" in them in FIG. 6). Collectors 191, 192 are interconnected by a screw feeder 191*a* arranged to convey reduced metal material from the bottom of collector 191 to a top of collector 192, which screw feeder 191*a* may also provide a gas-tight seal between collectors 191, 192. There may also be a valve between collectors 191, 192, as illustrated in FIG. 6. In other embodiments, collectors 191, 192 may communicate, and gas evacuation and filling may then take place only via one of these collectors 191, 192.

Each of input collectors 181, 182 may comprise a respective input for metal material to be reduced; and may further comprise a bottom screw feeder 181*a*, 182*a*, arranged to transport metal material along a respective bottom of the collector 181, 182 in question towards a respective output of the collector 181, 182 in question leading to the furnace space 120.

A most upstream one 191 of said output collectors 191, 192 may comprise an input arranged to receive reduced metal material from the furnace space 120.

A most downstream one 192 of said output collectors 191, 192 may comprise a screw feeder 192*a*, arranged to transport reduced metal material along a bottom of the collector 192 to an output for reduced material.

A vacuum pump V may be connected to each of said collectors 181, 182, 191, 192. Furthermore, a source of pressurized inert and/or reducing gas (such as nitrogen gas and/or hydrogen gas) H may be connected to each of said collectors 181, 182, 191, 192.

Each of the input collectors 181, 182 of the input 144 may then be operated by using the vacuum pump V to evacuate an existing atmosphere of the input collector 181, 182 in question. Then, the source H may be used to flush each of said input collectors 181, 182 with an inert gas. Then, the source H may be used to fill each of said input collectors 181, 182 with reducing gas, to a desired pressure such as an overpressure currently prevailing in the furnace space 120. Thereafter, the corresponding valve may be opened to release metal material to be reduced from the input collector 181, 182 in question into the furnace space 120. When an input collector 181, 182 is empty, the corresponding valve to the furnace space may be closed and the input collector 181, 182 in question may be replenished, via the respective valve in the top part of the input collector 181, 182 in question, with new metal material to be reduced, and the input collector 181, 182 will again be put under vacuum; possibly flushed with inert gas and/or filled with reducing gas. Then, the input collector 181, 182 can once more deliver metal material to be reduced to the furnace space 120. Preferably, the input collectors 181, 182 are operated in an alternating manner, so that one of them is replenished with new material and prepared to deliver to the furnace space 120. This way, a continuous flow of metal material to be reduced and possibly carburized can be delivered to the furnace space 120, under a desired overpressure, without any atmospheric air leaking into the closed loop described herein.

At the beginning of the process, the output collectors 191, 192 are sealed using the corresponding valves. An existing atmosphere in at least a downstream arranged one 192 of said output collectors 191, 192, preferably all output collectors, may be evacuated, using vacuum pump V. Then, said one or several of said output collectors 191, 192 may be flushed with inert gas, and may be replenished with reducing gas, using source H and in a way corresponding to the process described in relation to input collectors 181, 182.

Then, reduced and possibly carburized metal material is received into collector 191, via the corresponding valve being opened, from the furnace space 120, the metal material falls to the bottom of the collector 191. From there, it can be transported into collector 192, via screw feeder 191*a* and an opened valve between collectors 191, 192. During such transport between collectors 191, 192, the output valve of downstream collector 192 may be closed. When the downstream collector 192 is emptied, the valve between the upstream collector 191 and the downstream collector 192 may be closed, effectively creating a gas lock.

In general, an input metal material delivery mechanism according to the present invention may comprise at least one, preferably several, input metal material collectors 181, 182 that are separately gas-tightly sealable and arranged to be evacuated, flushed with inert gas and/or filled with reducing gas, and that are arranged to selectively deliver metal material to be reduced and possibly carburized to the furnace space 120 from such a gas-tightly sealed and reducing gas-filled space, via a closable valve.

Correspondingly, an output reduced and possibly carburized metal material discharge mechanism may comprise at least one, preferably several, series-connected output metal material collectors 191, 192, being gas-tightly sealable and arranged to be evacuated, flushed with inert gas and/or filled with reducing gas, and that are arranged to selectively receive reduced and possibly carburized metal material from the furnace space 120 to such a gas-tightly sealed and reducing gas-filled space, via a closable valve.

The fluidised bed 141 illustrated in FIGS. 1*a* and 1*b* is of course suitable mainly when the metal material 142 is in powder form. As an alternative to the fluidised bed 141, the metal material 142 may instead rest completely on the floor 151 while the gas is provided upwards through the floor 151 and through the material 142 at a gas velocity not enough to lift the material 142 hence forming a fluidised bed. This alternative is useful when the metal material 142 is charged as granular material with larger particle sizes.

Then, the metal material 142 rests, during operation, on the gas-permeable floor 151, the gas flowing through the floor 151 in an upwards direction and past the metal material 142 without expanding or suspending the metal material 142 to form a fluidised bed. In this case, the metal material 142 may be charged and discharged in a batch-wise manner, such as by opening the furnace space 120 to remove reduced/carburised material and to refill with new metal material to be reduced/carburised. It is realized that what is said in relation to FIGS. 1*a* and 1*b*, and what is illustrated therein, is analogously applicable to the non-fluidised bed alternative.

Advantageously, in either the fluidised bed alternative shown in FIGS. 1*a* and 1*b* or the non-fluidised bed alternative, the furnace space 120 is not charged with very large amounts of material 142 to be reduced/carburised. Each furnace 100 is preferably charged with at the most 50 tonnes, such as at the most 25 tonnes, such as between 5 and 10 tonnes, in each batch or any given point during continuous processing. Depending on throughput requirements, several furnaces 100 may be used in parallel, and the residual heat from one furnace 220 can then be used to preheat another furnace 210 (see FIG. 2 and below).

This provides a system 200 which is suitable for installation and use directly at the mining site, requiring no expensive transport of the ore before reduction. Instead, direct reduced and possibly carburized metal material can be produced on-site, packaged under a protecting atmosphere and transported to a different site for further processing.

In the case of water-rolled iron ore balls and other granular material to be processed in a batch-wise manner in the furnace 100, it is foreseen that the furnace 100 may be installed in connection to a material production system, such as an iron ore ball production system, so that charging of the metal material 142 into the furnace 100 can take place in a fully automated manner.

For instance, the material 142 can be charged and discharged in containers with gas-permeable bottoms, where such a container can either be placed onto the gas-permeable floor 151 or form the gas-permeable floor after charging of the container in question into the furnace space 120.

Then, such containers may be automatically circulated from the material production system to the furnace 100 and back, being filled with material to be reduced and possibly carburized; inserted into the furnace space 120; subjected to the reducing and possibly carburizing hydrogen/heat/carbon-containing gas processing described herein; removed from the furnace space 120 and emptied; taken back to the material production system; refilled; and so forth. Several furnaces 100 may then be used in parallel; and more containers may be used than furnaces 100, so that in each batch switch a reduced and possibly carburized charge in a particular container is immediately replaced in the furnace 100 with a different container carrying material not yet reduced or carburized. Such a larger system, such as at a mining site, may be implemented to be completely automated, and also to be very flexible in terms of throughput, using several smaller furnaces 100 rather than one very large furnace.

The main reduction and possible carburization step, including said condensing, may be performed so that a pressure of more than 1 bar is built up in the furnace space 120 in relation to atmospheric pressure. In particular, the hydrogen gas may be provided so that said pressure of more than 1 bar is achieved and maintained. It is noted that such a pressure of more than 1 bar is a pressure which is higher than atmospheric pressure.

The method may further comprise a carbon-provision step, namely a step in which a carbon-containing gas is provided to the furnace space 120, so that the metal material 142 that has been heated by said supplied heat and reduced by reaction with said reducing gas is carburized by said carbon-containing gas. This provision of carbon-containing gas may then be performed as a part of said main reduction and possible carburizing step, and is then performed before an evacuation of gases from the furnace space 120 back to atmospheric pressure in the furnace space 120. Such evacuation may be performed as a step of the present method, as will be explained below, performed for instance as a part of a material cooling substep.

The carbon-containing gas may be any carbon-containing gas which can chemically react with the reduced metal material so as to carburize the latter. Examples of suitable carbon-containing gases comprise various gaseous (at the temperatures and pressures prevailing in the furnace space 120 during the performance of the present method) hydrocarbons, such as methane, ethane, propane, propene and similar. Preferably, the carbon-containing gas does not contain more than trace amounts of carbon monoxide, since this will efficiently prevent both carbon monoxide and carbon dioxide from forming residual products after the finalization of the present carburization process. In particular, it is preferred that no carbon monoxide is supplied to the furnace space 120 in said carbon-provision step.

As will be described and exemplified below, the carbon-provision step may be performed at least partly at the same time as the provision of hydrogen gas and heat described above. In particular, the carbon-provision step may be performed as a part of said main reduction and possible carburization step.

As described above, during reduction of iron free iron (Fe) is formed, which is then open for receiving carbon (C) to form $Fe_3C$.

FIG. 5 illustrates the ability for $H_2$ to reduce $Fe_2O_3$ as function of increasing temperature. As is hinted FIG. 5, reduction using hydrogen gas is particularly active in the temperature interval of roughly 400°-700°.

Correspondingly, carburization of the same $Fe_2O_3$ using a gaseous carbon source is most active in an interval stretching roughly between 650°-900°.

$Fe_3O_4$, for instance, displays similar properties with respect to reduction/carburization and temperature.

This means that a process that first performs most of the reduction of metal material at relatively lower temperatures, and then, after additional heating, performs most of the carburization of the metal material 142, will be efficient.

It is also the case that the carburization process is aided by the presence of water vapour, which as it turns out is present due to the reduction process of the same metal material 142.

In the particular case of methane as the carbon-containing gas and hematite/magnetite as the metal material, the following carburizing chemical reactions accrue in the furnace space:

$$Fe_3O_4 + 4H_2 = 3Fe + 4H_2O$$

$$3Fe + CH_4 = Fe_3C + 2H_2$$

The reaction between $CH_4$ and Fe comprises a sub reaction in which methane reacts with the water vapour formed by the reducing hydrogen gas:

$$CH_4+H_2O=2CO+3H_2$$

Then, the carburization per se takes place mainly via the well-known hydrogen-water reaction, in which carbon monoxide and hydrogen react with the formed iron surface, and form water vapour, while the freed carbon atom can be taken up at the location for the previously freed oxygen atom.

Since the surface of the reduced iron particles is porous due to the reduction, the total iron surface area will typically be very large even in case the charged metal material 142 is in the form of larger particles such as pellets or balls, leading to an efficient carburization process, in particular when the metal material is provided as a granular material.

As can be seen from the above formulas, a certain amount of hydrogen gas is formed by the carburization process, why less hydrogen gas is required than what would have otherwise been the case.

It is preferred that the finally carburized metal material, after the finishing of the carbon-provision step, has a carbon content of between 1%-4% by weight.

The supply of hydrogen gas in the main reduction and possible carburization step may preferably be controlled to achieve and maintain a predetermined hydrogen partial pressure, or a predetermined total pressure, being higher than 1 bar, inside the furnace space 120. In a corresponding manner, the provision of carbon-containing gas in the carbon-provision step may be controlled to achieve and maintain a predetermined partial pressure, or a predetermined total pressure, being higher than 1 bar, inside the furnace space 120.

It is preferred that no hydrogen gas is evacuated from the closed loop until a desired reduction, such a complete reduction, has been completed of the metal material 142. Similarly, it is preferred that no carbon-containing gas is evacuated from the closed loop until a desired carburization, such as complete reduction, has been completed of the metal material 142.

In particular, the supply of hydrogen gas in the main reduction and possible carburization step may be controlled to achieve and maintain a predetermined pressure being higher than 1 bar in the furnace space 120, which predetermined pressure may be at least 2.3 bar, more preferably at least 2.5 bar, or even about 3 bar or more. The corresponding is true for a possible pressure-regulating provision of carbon-containing gas in the reduction and possible carbon-provision step.

Independently of the gas pressure as such, the velocity of the gas through the floor 151 must also be high enough to be able to "lift" the layer of powder or particles (as the case may be) to separate from each other and to open the surfaces of the particles for the gas to penetrate.

In some embodiments, the provision of additional reducing gas is performed to maintain said predetermined pressure until no additional reducing gas is actually required to maintain said predetermined pressure.

Alternatively or additionally, the provision of additional reducing as may be performed to maintain said predetermined pressure until a predetermined amount of water has been collected in the condenser 280.

Both these conditions indicate that full reduction has been achieved. After such indication has been received, a new batch can be charged, or the next cycle in a continuous processing can be initiated.

Further alternatively, the supply of reducing gas and heat in the main reduction and possible carburization step may be performed until the charged metal material 142 to be reduced has reached a predetermined temperature, which may be at least 600° C., such as between 640-680° C., preferably about 660° C., alternatively until the charged metal material reaches a temperature of between 700-1100° C., such as between 800-1100° C. (see below). The temperature of the charged material 142 may be measured directly, for instance by measuring heat radiation from the charged material using as suitable sensor, or indirectly by measuring the temperature of gas that has passed through the metal material 142.

In some embodiments, the main reduction and possible carburization step of any may be performed during a continuous time period of at least 0.25 hours, such as at least 0.5 hours, such as at least 1 hour, with respect to each particular piece of charged material 142 (irrespectively of if using a batch-wise or continuous process). During this whole time, both the pressure and temperature of the furnace space 120 may increase monotonically to predetermined values and then be maintained.

In some embodiments, the main reduction and possible carburization step may furthermore be performed iteratively, in each iteration the control device 201 allows a steady state pressure to be reached inside the furnace space 120 before supplying an additional amount of hydrogen gas into the furnace space. The heat provision may also be iterative (pulsed), or be in a switched on state during the entire main reduction and possible carburization step.

During the initial step and the main reducing and possible carburization step, with the possible exception of a time period in connection to the start of a carbon-provision step, in which the total furnace space 120 pressure may be temporarily decreased, the control device 201 may control the system 200, to, at all times, maintain or increase the pressure by supplying additional hydrogen gas and/or carbon-containing gas. Supplied hydrogen gas is used to compensate for hydrogen consumed in the reduction process, and also to gradually increase the pressure to a desired final pressure. Carbon-containing gas can be supplied using any one of a number of different strategies (as explained below), and may for instance be controlled so as to achieve a set target total pressure in the furnace space 120 during such provision.

It is understood that the pressures can be increased using either suitable compressors or an available overpressure from sources 261, 262, 263, as is conventional as such.

As mentioned, the method further may comprise a carburization step performed, as a part of said main heating and possible carburizing step, before discharging the metal material 142 from the furnace space 120. In such a carburization step, a carbon-containing gas such as a gaseous hydrocarbon is provided to the furnace space, so that the heated and reduced metal material is carburized by said carbon-containing gas.

Said carbon-containing gas may be supplied using one of several different strategies, as exemplified in the following.

FIRST EXAMPLE

In a first such strategy, illustrated in FIG. 4*a*, the reduction using the reducing gas is directly followed by carburization of the metal material. Firstly, hydrogen gas and heat may be supplied as described above, to the closed loop, to increase and maintain the pressure in the furnace space 120 while increasing the temperature in the furnace space 120, and as a result reducing the metal material 142. The finally maintained pressure may be as described above, for instance at least 1.1 bar, and preferably at least between 2.3-2.5 bar.

In this and other examples, when the reduction of the complete metal material charge 142 has finished, the furnace space 120 has reached a temperature of about 700° C., and the temperature of the hydrogen gas going into the furnace space 120 has the same temperature as the gas entering the heat exchanger of the condenser 280.

Generally in this first strategy, heat may be provided in said main reduction and possible carburization step until the metal material 142 reaches a temperature of at least 500° C., such as at least 600° C., before the provision of the carbon-containing gas starts in said carbon-provision step.

At this state, when the reduction is complete, no carbon-containing gas has been supplied yet. Before doing so, or in connection to doing so, part of the hydrogen gas may be evacuated so as to lower the partial hydrogen gas pressure. Namely, valve V2 may be closed to terminate hydrogen gas supply. Then, the compressor 250 may be used to evacuate some of the hydrogen gas, by suitable valves being opened/closed, to a storage container for used hydrogen. When the pressure has been lowered, to a lower pressure of between 1.1 and 1.8 bar, such as between 1.3 and 1.6 bar, such as about 1.5 bar, valve V2 is closed and valve V3 is opened, and the carbon-provision step starts.

As is illustrated in FIG. 4*a*, after this partial hydrogen gas evacuation the total pressure in the furnace space 120 is about 1.5 in this example.

In general, the carbon-provision step may be at least partly, preferably completely, performed at a furnace space 120 pressure which is lower than a furnace space 120 pressure prevailing at the time for finalizing the reduction process.

Fresh carbohydrate gas, for instance methane, may be stored in one container, while previously used carbohydrate gas (such as a mixture of methane and hydrogen) may be stored in a different container, using suitable gas flows as controlled by the control device 201 controlling valves and compressors as required.

At this point, the newly reduced metal material 142 can accept the provided carbon. The carburization takes place under increased furnace space 120 temperature, via heating using heating element 175. Depending on the metal material constitution, the carburization is finished when the temperature has reached about 700° C.-1100° C. As mentioned above, during the carburization a certain amount of hydrogen is formed as a result.

Thereafter, the below-described cooling and emptying steps can be started.

FIG. 4*a* illustrates, in a schematic chart, a process according to this first strategy, in which the carbon-containing gas is added after the reduction is completed. The chart illustrates hydrogen gas partial pressure (full line) as a function of furnace space 120 temperature, and also carbon-containing gas partial pressure (broken line) as a function of furnace space 120 temperature, during the process.

It is noted that FIG. 4*a*, as is the case also with FIGS. 4*b* and 4*c*, are simplified in the sense that they ignore any residual gas present in the furnace space 120 or the rest of the closed loop after the initial evacuation.

SECOND EXAMPLE

In a second strategy, the carbon-containing gas is supplied before the reduction is completed.

During the heating and the commencing reduction, hydrogen gas is supplied so as to achieve and maintain an increasing total furnace space 120 pressure of at least 1.1 bar, and preferably at least 2.3 bar. In this case, the carbon-containing gas is supplied shortly after the reduction has started, in other words after the temperature in the furnace space 120 has reached at least 350° C., such as between 350-450° C., such as at about 400° C. In general in this second strategy, the carbon-provision step only starts after the metal material has reached a temperature of between 350-450° C.

In this strategy, the reduction and the carburization take place in parallel during the main reduction and carburization step, and the pressure is maintained by the supplied carbon-containing gas. The supply is performed by the control device 201 controlling valves, any compressors, etc. in a suitable manner.

During the whole reduction process, both heat and more carbon-containing gas until the reduction approaches finality, which takes place at about 700° C. At this point, the temperature is increased to a final temperature of more than 700° C. and preferably at the most 1100° C. while the pressure is being maintained by a continuous supply of mixed gas, containing a mixture of hydrogen gas and carbon-containing gas.

Thereafter, the below-described cooling and emptying steps can be started.

FIG. 4*b* is a chart corresponding to the one shown in FIG. 4*a*, but illustrating this second strategy.

THIRD EXAMPLE

In a third strategy, the supply of carbon-containing gas starts as the reduction reaches its maximum. For hematite and magnetite, this occurs at about 550-570° C.

In this strategy, the pressure is increased to at least 1.1 bar, preferably to at least 2.3-2.5 bar by supply of hydrogen gas, together with heating, to the furnace space 120 as described above.

As the temperature of the gases exiting the charge approaches 550° C., the supply of hydrogen gas is shut off. At this point, a major part of the charge will already have been fully reduced, and now consists of pyrophoric iron which is ready to receive carbon supplied via carbon-containing gas. This is achieved by opening, for example, valve V3.

Carburization then takes place after or partly in parallel to the reduction, and the pressure is maintained by supply of the carbon-containing gas. As mentioned above, a certain amount of hydrogen gas is formed as a result of the carburization, and an unwanted resulting pressure increase can be handled, for instance, by evacuating part of the furnace space 120 atmosphere to a container for a used mixture of hydrogen and carburizing gas.

The temperature is increased during the whole process. After a predetermined temperature, such as of between 650-750° C., preferably between 690-700° C., the temperature is thereafter increased under constant pressure, more precisely a pressure of at least 1.1, preferably to at least 2.3-2.5 bar, to a higher temperature, which is at least 800° C., such as 800-1100° C. The constant pressure is maintained by supply of carbon-containing gas, preferably fresh carbon-containing gas, using suitable valve settings and, if needed, suitable compressors.

Thereafter, the below-described cooling and emptying steps can be started.

In general in this third strategy, the carbon-provision step only starts after the metal material has reached a temperature of between 450-550° C., and the provision of hydrogen gas may thereafter be terminated. On the other hand, the carbon-provision step may then also comprise continuing to provide heat to the furnace space 120.

Furthermore, in general in this third strategy, heat is provided in the main reduction and carburization step, and in particular during the carbon-provision step, until the metal material reaches a temperature of between 700-1100° C., such as between 800-1100° C.

As mentioned, the carbon-provision step in this third strategy may comprise providing heat to the furnace space 120 at a constant pressure, which pressure is controlled by a controlled supply of carbon-containing gas, and which provided carbon-containing may or may not be mixed with hydrogen gas.

FIG. 4*c* is a chart corresponding to the one shown in FIG. 4*a*, but illustrating this third strategy. It is particularly noted that the partial pressure of hydrogen gas decreases above 600° C., which is because of hydrogen formed by the carburization reaction.

After full reduction and possible carburization has occurred, the method according to the present invention comprises a cooling and emptying step, that will be described in the following.

Hence, in a subsequent cooling step, the hydrogen gas/carbon-containing gas atmosphere in the furnace space 120 is then cooled to a temperature of at the most 100° C., preferably about 50° C., and is thereafter evacuated from the furnace space 120, preferably from the entire closed circuit, and collected.

In the case of a single furnace 100/220, which is not connected to one or several furnaces, the charged material may be cooled using the propulsion device 250 forcing the gas in the closed loop (propulsion device 250; valves V5, V6; heat exchanger in condenser 280; furnace 220; valve V16; heat exchanger 240; valve V9) past the gas-water type cooler 240, in turn being arranged to cool the hydrogen/carbon-containing gas.

The heat exchanger 240 hence transfers the thermal energy from the circulated hydrogen/carbon-containing gas to water (or a different liquid), from where the thermal energy can be put to use in a suitable manner, for instance in a district heating system.

Since the hydrogen/carbon-containing gas in this case is circulated past the charged material 241 in the furnace 220, it absorbs thermal energy from the charged material 212, providing efficient cooling of the charged material 241 while the hydrogen/carbon-containing gas is circulated in a closed loop.

In a different example, the thermal energy available from the cooling of the furnace 100/220 is used to preheat a different furnace 210. This is then achieved by the control device 201, as compared to the above described cooling closed loop, closing the valve V15 and instead opening valves V13, V14. This way, the hot hydrogen/carbon-containing gas arriving from the furnace 220 is taken to the gas-gas type heat exchanger 230, which is preferably a counter-flow heat exchanger, in which hydrogen gas being supplied in an initial or main reduction and possible carburization step performed in relation to the other furnace 210 is preheated in the heat exchanger 230. Thereafter, the somewhat cooled hydrogen/carbon-containing gas from furnace 220 may be circulated past the heat exchanger 240 for further cooling before being reintroduced into the furnace 220. Again, the hydrogen/carbon-containing gas from furnace 220 is circulated in a closed loop using the propulsion device 250.

Hence, the cooling of the hydrogen/carbon-containing gas in the cooling step may take place via heat exchange with hydrogen gas to be supplied to a different furnace 210 space 120 for performing the initial and main heating/carburization steps and the condensation, as described above, in relation to said different furnace 210 space 120.

Once the hydrogen/carbon-containing gas is insufficiently hot to heat the hydrogen gas supplied to furnace 210, the control device 201 again closes valves V13, V14 and reopens valve V15, so that the hydrogen/carbon-containing gas from furnace 220 is taken directly to heat exchanger 240.

Irrespectively of how its thermal energy is taken care of, the hydrogen/carbon-containing gas from furnace 220 is cooled until it (or, more importantly, the charged material) reaches a temperature of below 100° C., in order to avoid reoxidation of the charged material when later being exposed to air.

The cooling of the hydrogen/carbon-containing gas may take place while maintaining the pressure of the hydrogen/carbon-containing gas, or the pressure of the hydrogen/carbon-containing gas may be lowered as a result of the hot hydrogen/carbon-containing gas being allowed to occupy a larger volume (of the closed loop conduits and heat exchangers).

In a subsequent step, the hydrogen/carbon-containing gas is evacuated from the furnace 220 space 120, and preferably from the entire closed loop, and collected in a suitable container for used gas. Normally, the furnace space 120 will at this point contain either reducing gas or a mixture of reducing and carbon-containing gas, possibly with other gases such as remaining water vapour, and this gas or gas mixture is then evacuated to a container for used carbon-containing gas. The evacuation of the furnace space 120 is preferably performed until a pressure of at the most 0.5 bar, or even at the most 0.3 bar, is detected inside the furnace space 120.

Because of the use of the closed loop in which all gases are circulated by the propulsion device 250, only the hydrogen/carbon-containing gas consumed in the chemical reduction reaction has been removed from the system, and the remaining hydrogen gas is the one which was necessary to maintain the hydrogen gas/water vapour balance in the furnace space 120 during the main reduction and possible carburization step. This evacuated hydrogen gas is fully useful for a subsequent batch operation of a new charge of metal material to be reduced.

Thereafter, the closed loop may again be filled with air, an inert gas or hydrogen gas for a new batch run. The condensate water may also be emptied.

In a subsequent step, the furnace space 120 may hence be opened, such as by releasing the fastening means and opening the upper part 110. If a container is used, it is removed and is replaced with a container with a new batch of charged metal material to be reduced.

In a subsequent step, the removed, reduced material may then be arranged under an inert atmosphere, such as a nitrogen atmosphere, in order to avoid reoxidation during transport and storage.

For instance, the reduced metal material may be arranged in a flexible or rigid transport container which is filled with inert gas. Several such flexible or rigid containers may be arranged in a transport container, which may then be filled with inert gas in the space surrounding the flexible or rigid containers. Thereafter, the reduced metal material can be transported safely without running the risk of reoxidation.

In the alternative case of continuous processing, it is still possible and sometimes desirable to use heat exchangers 230, 240, in corresponding manner and arranged downstream of the furnace 120 in said closed loop, to cool the water-containing hot gas exiting the furnace space 120 in order to achieve a fuller condensing of the entrained water.

The following table shows the approximate equilibrium between hydrogen gas $H_2$ and water vapour $H_2O$ for different temperatures inside the furnace space 120:

| Temperature (° C.): | 400 | 450 | 500 | 550 | 600 |
|---|---|---|---|---|---|
| $H_2$ (vol-%): | 95 | 87 | 82 | 78 | 76 |
| $H_2O$ (vol-%): | 5 | 13 | 18 | 22 | 24 |

About 417 $Nm^3$ hydrogen gas $H_2$ is required to reduce 1000 kg of $Fe_2O_3$, and about 383 $m^3$ hydrogen gas $H_2$ is required to reduce 1000 kg of $Fe_3O_4$.

The following table shows the amount of hydrogen gas required to reduce 1000 kg of $Fe_2O_3$ and $Fe_3O_4$, respectively, at atmospheric pressure and in an open system (according to the prior art), but at different temperatures:

| Temperature (° C.): | 400 | 450 | 500 | 550 | 600 |
|---|---|---|---|---|---|
| $Nm^3$ $H_2$/tonne $Fe_2O_3$: | 8340 | 3208 | 2317 | 1895 | 1738 |
| $Nm^3$ $H_2$/tonne $Fe_3O_4$: | 7660 | 2946 | 2128 | 1741 | 1596 |

The following table shows the amount of hydrogen gas required to reduce 1000 kg of $Fe_2O_3$ and $Fe_3O_4$, respectively, at different pressures and for different temperatures:

| Temperature (° C.): | 400 | 450 | 500 | 550 | 600 |
|---|---|---|---|---|---|
| | $Nm^3$ $H_2$/tonne $Fe_2O_3$: | | | | |
| 1 bar | 8340 | 3208 | 2317 | 1895 | 1738 |
| 2 bar | 4170 | 1604 | 1158 | 948 | 869 |
| 3 bar | 2780 | 1069 | 772 | 632 | 579 |
| | $Nm^3$ $H_2$/tonne $Fe_3O_4$: | | | | |
| 1 bar | 7660 | 2946 | 2128 | 1741 | 1596 |
| 2 bar | 3830 | 1473 | 1064 | 870 | 798 |
| 3 bar | 2553 | 982 | 709 | 580 | 532 |

As described above, the main reduction and possible carburization step according to the present invention is preferably performed up to a pressure of more than 1 bar and a high temperature. During the majority of a part of the main reduction and possible carburization step in which part reduction is ongoing, it has been found advantageous to use a combination of a heated hydrogen gas temperature of at least 500° C. and a furnace space 120 pressure of at least 2.3 bar.

It is noted that the final product achieved by a method and system according to the present invention may be a (possibly carburized) metal powder.

FOURTH EXAMPLE

The following is an example of an implementation of the present method, for a batch-wise processing of metal material to be reduced.

A container is charged into the furnace space 120, containing an amount of metal oxide to be reduced in the form of a powder or balls/pellets. The furnace space 120 is closed and sealed in a gas-tight manner.

The air contained in the furnace space 120 and the closed loop is then evacuated using pump 290, such as to 0.5 bars, by closing valves V1, V2, V3 and V41 and opening valves V4, V5, V6, V7, V8, V9, V12, V15, V16, V17, V42. If extra drying of the gas is required later, valves V10 and V11 are also opened.

When the evacuation is finalized, the closed loop is filled with nitrogen gas or hydrogen gas by opening valve V1 or V2, while closing valves V4, V16 and V42.

When the pressure in the closed loop reaches 1 bar, the heating elements 175 are switched on and the propulsion device (fan) 250 is started. Valves V7 and V15 are closed and the water supply to the water cooler 281 and the heat exchanger 240 is switched on. The gas will flow from the fan 250, via valves V5 and V6, on to the external tubes of the gas-gas heat exchanger in the condenser 280, further via valve V17 into the heating device 174 at the bottom of the furnace 220, where the gas is heated by heating elements 175. Thereafter, the heated gas flows upwards through the gas distribution space and up through the gas-permeable floor 151, into the material 142 to be reduced to mix there-with. The gas hence reduces this material 142 and brings with it the formed water vapour to the cyclone separator 270, where any particulate matter is separated out, after which the gas flows on to the condenser 280, where the water vapour is condensed and the water is collected. The gas passes the gas-water heat exchanger 281, where final condensation of any remaining water vapour is achieved. The condensed water is collected in the condensed-water tank underneath and the cooled gas continues via V8 and on into the gas-water heat exchanger 240, where the gas is further cooled. Then, the gas flows back, via valve V9, to the fan 250.

If additional drying of the gas is required, valve V9 can be closed and valves V10 and V11 be opened, so that the gas passes the gas dryer 282 before it reaches the fan 250 again. The dryer the hydrogen gas, the faster the reduction process, and as long as there is an ongoing reduction of the material 142 hydrogen gas is consumed which needs to be compensated by addition of hydrogen gas. In case an inert gas, such as nitrogen gas, is used during the initial heating step, this can be evacuated and collected before the main heating step, to be replace for the main heating step with hydrogen gas.

When for instance hydrogen gas is used in the initial heating step and a suitable temperature, such as 350-400° C., has been reached, the reduction starts and the pressure in the furnace space 120 can be increased to 2-3 bars or more, so that a larger mass of hydrogen gas is made available for reduction and thereby speeding the process up.

In order to compensate for the endothermal oxide reduction reaction when using hydrogen gas, the temperature provided at heating elements 175 should be higher than asked for. The more heavily oxidised the material 142, the higher the heating temperature should be.

If the charged material 142 is acidic, the heat provided by the heating elements 175 may advantageously be higher, in order to compensate for the endothermal reaction at reduction of the oxide using hydrogen gas. The more heavily oxidized the material 142 is, the higher the temperature should be.

Using the fan 250, the gas can be circulated in two different paths: If the gas is to be "dried", it will arrive from the condenser 280 via valves V8 and V9 into heat exchanger 240 where it is cooled further and hence dried. Valve V7 is in this case closed. Should the gas still not be dry enough, the gas dryer 282 is arranged between the gas-water heat exchanger 240 and the fan 250, and valve V9 is then closed while valves V10 and V11 are opened. If the gas does not require additional drying, which may be the case when carburizing using for instance methane, valves V8, V9, V10 and V11, are closed while valve V7 is opened, and the gas is brought back to the condenser 280 using the fan 250 via valves V5 and V6. If valves V7-V11 are opened or partly opened, the reducing hydrogen gas can have a moisture content which is desirable in a process to be performed for instance when carburizing of the material 142 in connection to reduction.

During the whole process, additional hydrogen gas is supplied to maintain the desired hydrogen gas pressure in the closed loop and in particular in the furnace space 120.

Once the reduction is finalized, as established for instance by measuring a predetermined expected amount of condensed water or once it is clear, by no additional hydrogen having to be supplied to maintain the pressure, that the consumption of hydrogen gas has stopped, the cooling step can commence.

In this cooling step, valve V17 is closed and V16 is opened. The heating element 175 is switched off.

For a single-furnace setup, valves V7, V8 and V12 are closed, while valve V15 is opened. The fan 250 is set to a high or max fan speed. The gas will then be circulated via valves V5 and v6, past the external tubes in the condenser 280, through V16, past the distribution space in the furnace 220, up through the floor 151, through the reduced metal material 142, being either a powder-formed charged metal oxide material or being in the form of larger-body particulate material, and into the upper part of the furnace space 120, through the reduced metal material 142, being either a powder-formed charged metal material or being in the form of larger-body particulate material. The gas will flow on via valve V15 to heat exchanger 240, in which heat is transferred from the gas to the water, in turn being put to good use in for instance a district heating system or similar. The cooled gas is brought on via valve V9 back to fan 250.

For a multi-furnace setup, valves V7, V8 and V15 are closed, while valves V9, V13 and V14 are opened. The gas passes via valves V5 and V6, through the external tubes of condenser 280, into the gas distribution space, up through the floor 151, through the reduced metal material 142, out via valve V13 to heat exchanger 230, further via valve V14 to heat exchanger 240, via valve V9 back to the fan 250. When transferring heat from furnace 220 to furnace 210 this way, only about half of the thermal energy available in furnace 220 can be made useful in furnace 210 before temperature equilibrium is reached between these two furnaces 220, 210. When this has happened, valves V13 and V14 can be closed, and valve V15 can be opened, and the additional cooling of the metal material 142 can be achieved using heat delivery to the water via heat exchanger 240. Again, when needed the dryer 282 can be used to dry the cooling hydrogen gas, by closing valve V9 and closing valves V10 and V11.

Once the reduced metal material 142 has been cooled to below 100° C., the hydrogen gas is evacuated to a storage for used hydrogen gas, using a compressor. In the case of a multi-furnace setup, valves V13 and v14 need to be opened, so that hydrogen gas contained in that sub-loop is also evacuated.

Finally, the container with the reduced metal material 142 is removed from the furnace space 120, and the reduced metal powder or particles are packed on pallets or in containers for further transport. Preferably, such transport takes place directly to users of the reduced metal powder, such as to a steelworks or to a smelting plant to be used as a replacement for scrap steel material to be smelted. The metal powder can be directly blown into the steel smelt.

When transporting reduced metal material from steelworks, such as scale, grinding residues to be returned to the original steelworks, no extra protection is required to avoid reoxidation. However, in case the original material is highly oxidized material, such as hematite, magnetite or pyrite, the reduced material should be packaged under an inert gas to avoid reoxidation, unless it has undergone certain carburization during the process according to the present invention. The transport itself can take place in small container modules.

In case the reduced material is a reduced iron or iron alloy, such as scales or grinding residues, the product can be charged directly into an electro steel furnace, and does not require any addition processing before charging into the smelting furnace.

FIFTH EXAMPLE

Now, an example will be described in the form of a continuous process according to the present invention.

In general, a system for a continuous process corresponds to the system described in the fourth example for a batch-wise processing, but with additional arrangements at said input 144 and said output 145 of the furnace space 120. In particular, the input 144 and output 145 are preferably arranged to allow the furnace space 120 to operate both under a slight underpressure as well as under an overpressure without allowing any atmospheric air into the closed loop during charging or discharging of the metal material 142.

In order to solve this problem, the supply of additional reducing gas (to maintain the predetermined pressure as the reduction process consumes reducing gas) can be performed in connection to supply of additional material via input 144, so that a small temporary overpressure resulting from said reducing gas provision counteracts leakage of air into the furnace space 120 via input 144.

The material discharged via output 145 will be hot and would therefore preferably be conveyed to a connected of completely separate cooling system for cooling of the reduced and possibly carburized discharged material.

In a continuous process, the metal material 142 can be charged in charging containers, as has been described above for batch-wise processes. Then, several such gas-permeable-bottom charging containers may be connected and transported in a continuous-process manner through the furnace space, across the gas-permeable floor 151. In a first phase of such transport from the input 144 to the output 145, the metal material in such a charging container will then be heated/dried, and in a second phase of such transport the metal material in such a charging container will be reduced. Thereafter, the metal material may be discharged in its container, via output 145, and brought to a cooling step.

In a bubbling or circulating fluidised bed reactor, no charging containers are necessary—the metal material 142 is transported by gravity in combination with the supply via input 144 and the fluidising gas supply through the floor 151. The same type of first and second phases as described for the charging container case can also be applied in such containerless embodiments.

Above, preferred embodiments have been described. However, it is apparent to the skilled person that many modifications can be made to the disclosed embodiments without departing from the basic idea of the invention.

For instance, the geometry of the furnace 100 may differ, depending on the detailed prerequisites.

The heat exchanger in the condenser 280 is described as a tube heat exchanger. Even if this has been found to be particularly advantageous, it is realized that other types of gas-gas heat exchangers/condensers are possible. Heat exchanger 240 may be of any suitable configuration.

The surplus heat from the cooled hydrogen/carbon-containing gas may also be used in other processes requiring thermal energy.

The metal material to be reduced and possibly carburized has been described as iron oxides. However, the present method and system can also be used to reduce and carburize metal material such as the above-mentioned metal oxides containing Zn and Pb, that evaporate at temperatures below about 600-700° C.

The present combined direct reduction and carburizing principles can also be used with metal materials having higher reduction temperatures than iron ore, with suitable adjustments to the construction of the furnace 100, such as with respect to used construction materials.

In several aspects, the present invention makes use of a "closed loop" through which gases are circulated using the propulsion device 250. It is realized that the exact flow path of this closed loop can be varied, by control of corresponding valves, but that it at all times is closed in a gas-tight manner to avoid gases escaping from the closed loop unless actively evacuated.

All embodiments and examples described herein are freely combinable so long as they are compatible. For instance, all which is said in relation to the present system is equally applicable to the present method, and vice versa. Another example is that FIG. 1*a* illustrates a "bubbling bed" with continuous charging, whereas FIG. 1*b* illustrates a "circulating bed" with batchwise charging. But the present invention can be applied with continuous or batch-wise charging/discharging either in a bubbling or circulating bed.

Hence, the invention is not limited to the described embodiments, but can be varied within the scope of the enclosed claims.

The invention claimed is:

1. A method for producing direct reduced metal material, comprising the steps:

a) charging metal material to be reduced into a furnace space, onto a gas-permeable floor;

b) providing heat and hydrogen gas into the furnace space, so that heated hydrogen gas heats the charged metal material to a temperature high enough so that metal oxides present in the charged metal material are reduced, in turn causing water vapour to be formed; and c) condensing and collecting the water vapour formed in step b in a condenser;

wherein the method further comprises an initial step of either evacuating an existing atmosphere from a closed loop comprising the furnace space to achieve a lower pressure than atmospheric pressure in the closed loop, or ventilating the closed loop by an inert gas, wherein the only gaseous matter provided into the closed loop during a main reduction step is hydrogen gas or a mixture of hydrogen gas and an inert gas, wherein the hydrogen gas is circulated in the closed loop upwards through said floor, upwards through the charged metal material, and further via said condenser and a gas forced circulation device, wherein no hydrogen gas is evacuated from the closed loop during the main reduction step until a desired reduction has been completed of the metal material, and wherein the method further comprises the step:

d) supplying additional hydrogen gas to achieve and/or maintain a predetermined pressure in said furnace space.

2. The method according to claim 1, wherein said flow of the hydrogen gas upwards through said floor and further through the charged metal material is arranged so that the charged metal material together with said hydrogen gas forms a fluidised bed.

3. The method according to claim 2, wherein said fluidised bed is a bubble bed in which the charged metal material stays on said gas-permeable floor.

4. The method according to claim 1, wherein said fluidised bed is a circulating bed in which the charged metal material is suspended above said gas-permeable floor, inside said furnace space.

5. The method according to claim 4, wherein in step a), the metal material is continuously charged into said furnace space.

6. The method according to claim 4, wherein the method further comprises the step:

e) continuously discharging reduced metal material from said furnace space.

7. The method according to claim 1, wherein the method further comprises an initial metal material provision step in which the metal material is provided in a powder form.

8. The method according to claim 7, wherein the material after said initial metal material provision step has a mean particle size which is between 10 μm and 20 mm.

9. The method according to claim 1, wherein said gas-permeable floor comprises or is formed by a perforated ceramic plate or of woven metal.

10. The method according to claim 1, wherein the gas forced circulation device is a compressor or a fan.

11. The method according to claim 1, wherein the method further comprises the initial step of evacuating an existing atmosphere from the furnace space so as to achieve a gas pressure of less than 1 bar inside the furnace space.

12. The method according to claim 1, wherein, in step d), the provision of additional hydrogen gas is performed so that a pressure of more than 1 bar builds up inside the furnace space.

13. The method according to claim 1, wherein the method further comprises evacuating gases from the furnace space back to atmospheric pressure after the charged metal material has been reduced.

14. The method according to claim 1, wherein the method further comprises a carburization step performed before an evacuation of gases from the furnace space back to atmospheric pressure, in which carburization step a carbon-containing gas is provided to the furnace space, so that the heated and reduced metal material is carburized by said carbon-containing gas.

15. The method according to claim 1, wherein step b) comprises a first heating sub step, in which either said hydrogen gas or an inert gas is circulated through the charged metal material to heat the charged metal material, and a second reduction step, in which the hydrogen gas is circulated through the charged metal material to achieve said reduction.

16. The method according to claim 15, wherein, in said first heating sub step, the charged metal material is heated to a temperature above the boiling temperature of water contained in the charged metal material, causing said contained water to evaporate.

17. The method according to claim 1, wherein the furnace space comprises a first volume upstream of said gas-permeable floor through which said hydrogen gas passes on its way to the charged metal material, and wherein the hydrogen gas is heated in said first volume.

18. The method according to claim 1, wherein the hydrogen gas is preheated in a heat exchanger, which heat exchanger is arranged to transfer thermal energy from water evaporated from the charged metal material to the hydrogen gas to be provided in step b.

19. The method according to claim 1, wherein the provision of additional hydrogen gas in step d is performed until no additional hydrogen gas is required to maintain said predetermined pressure and/or until a predetermined amount of water has been collected in said condenser.

* * * * *